US010080451B2

(12) United States Patent
Chen

(10) Patent No.: US 10,080,451 B2
(45) Date of Patent: Sep. 25, 2018

(54) TWIST-ACTION PORTION-CONTROL SAUCE DISPENSER

(71) Applicant: Franke Kindred Canada Limited, Saint John (CA)

(72) Inventor: Chi-En Chen, Burnaby (CA)

(73) Assignee: Franke Kindred Canada Limited, Saint John (CA)

( * ) Notice: Subject to any disclaimer, the term of this patent is extended or adjusted under 35 U.S.C. 154(b) by 0 days.

(21) Appl. No.: 15/298,087

(22) Filed: Oct. 19, 2016

(65) Prior Publication Data

US 2018/0014670 A1 Jan. 18, 2018

Related U.S. Application Data

(63) Continuation-in-part of application No. 15/252,794, filed on Aug. 31, 2016.

(60) Provisional application No. 62/361,688, filed on Jul. 13, 2016.

(51) Int. Cl.

| | |
|---|---|
| ***A47G 19/18*** | (2006.01) |
| ***B05C 17/005*** | (2006.01) |
| ***B05C 17/01*** | (2006.01) |
| *B65D 35/30* | (2006.01) |
| *B65D 35/28* | (2006.01) |
| *B65D 83/00* | (2006.01) |

(52) U.S. Cl.

CPC ..... *A47G 19/183* (2013.01); *B05C 17/00583* (2013.01); *B05C 17/012* (2013.01); *B65D 83/0005* (2013.01); *B65D 35/28* (2013.01); *B65D 35/30* (2013.01); *B65D 83/0077* (2013.01)

(58) Field of Classification Search

CPC ..... A47G 19/183; B05C 17/00583; B05C 17/012; B65D 35/28; B65D 35/30; B65D 83/0005; B65D 83/0077

See application file for complete search history.

(56) References Cited

U.S. PATENT DOCUMENTS

| | | | | | |
|---|---|---|---|---|---|
| 388,657 | A | | 8/1888 | Finlay | |
| 1,664,936 | A | | 4/1928 | Lyman | |
| 1,717,672 | A | | 6/1929 | Fitch | |
| 2,281,651 | A | | 5/1942 | Wolcott | |
| 3,229,865 | A | | 1/1966 | Heisler et al. | |
| 3,231,139 | A | | 1/1966 | Bouet | |
| 3,815,787 | A | * | 6/1974 | Spies | A47J 9/00 222/390 |
| 3,847,304 | A | * | 11/1974 | Cohen | B65D 83/0038 222/105 |
| 3,920,156 | A | | 11/1975 | Hicks | |
| 4,019,655 | A | * | 4/1977 | Moeller | A47K 5/08 222/101 |

(Continued)

*Primary Examiner* — Frederick C Nicolas

(74) *Attorney, Agent, or Firm* — Oyen Wiggs Green & Mutala LLP

(57) ABSTRACT

The invention relates to a twist-action, portion-control dispenser having a dispenser body, a grip ring attached to an exterior surface of the dispenser body, and a piston movably fitted within the dispenser body and coupled to the grip ring. The piston is configured to move incrementally downwards through the dispenser body when the grip ring is rotated relative to the dispenser body. A sauce pouch is contained within the dispenser body, in contact with the piston, such that sauce is dispensed from the dispenser as the piston is moved incrementally along the body.

22 Claims, 24 Drawing Sheets

(56) References Cited

U.S. PATENT DOCUMENTS 4,991,742 A * 2/1991 Chang ..... A61M 5/148 222/105
5,042,696 A 8/1991 Williams
5,238,150 A * 8/1993 Williams ..... B05B 9/0838 222/105
5,356,016 A * 10/1994 Wiedemann ..... A61J 9/001 215/11.1
5,356,037 A * 10/1994 Harrold ..... B65D 83/0005 222/105
5,873,490 A * 2/1999 Walpole ..... B65D 83/0005 222/105
5,894,957 A 4/1999 Egel
5,909,828 A 6/1999 Salisbury
6,364,163 B1 4/2002 Mueller
6,662,971 B1 12/2003 Nguyen et al.
6,761,286 B2 7/2004 Py et al.
6,968,977 B1 * 11/2005 Beene ..... B65D 35/28 222/101
7,140,518 B2 * 11/2006 Wang ..... B05B 9/0838 222/105
7,178,692 B2 2/2007 Ophardt
7,422,129 B1 9/2008 Herbert et al.
7,475,633 B2 * 1/2009 Weinberg ..... B29B 17/0052 100/226
7,694,849 B1 4/2010 Wiesner
8,240,932 B1 8/2012 Perez-Espartero et al.
8,627,987 B2 * 1/2014 Pollack ..... B65D 83/0005 220/8
9,016,508 B1 4/2015 Leighton et al.
2008/0110922 A1 5/2008 Sines
2009/0272763 A1 11/2009 Hasselstrom et al.
2012/0248152 A1 10/2012 Weill et al.
2013/0153600 A1 6/2013 Sanfilippo et al.
2014/0175131 A1 6/2014 Abrams
2014/0197195 A1 7/2014 Peuker et al.
2014/0224808 A1 8/2014 Brisard
2016/0332788 A1 11/2016 Chen
2017/0326580 A1 11/2017 Chen
2018/0014669 A1 * 1/2018 Chen ..... A47G 19/183

* cited by examiner

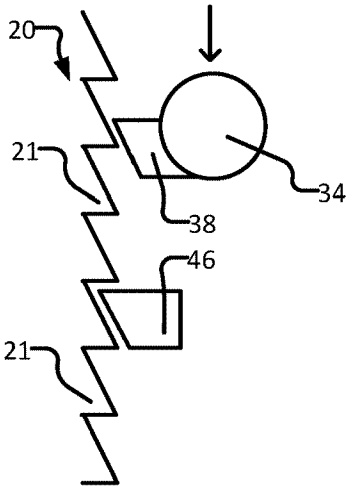
FIG. 10A
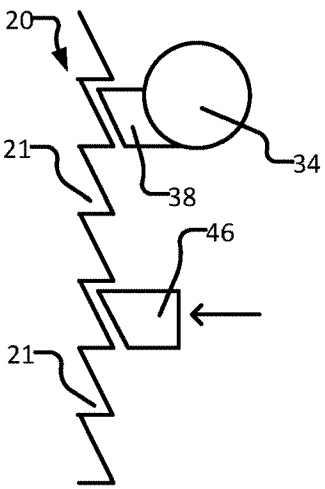
FIG. 10B
FIG. 10C
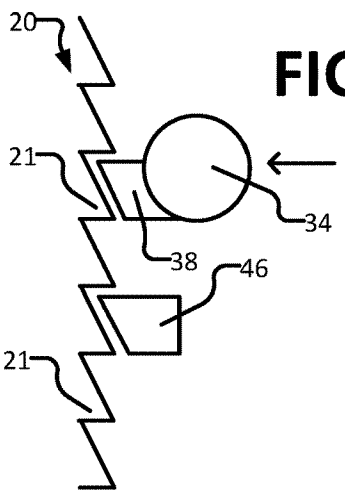
FIG. 10D
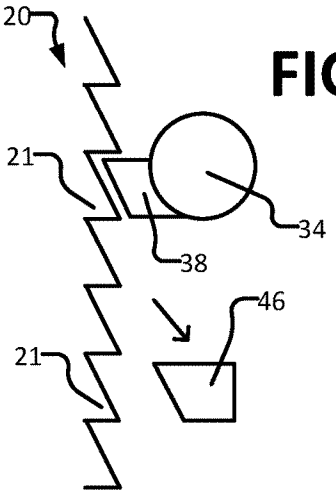
FIG. 10E

TWIST-ACTION PORTION-CONTROL SAUCE DISPENSER

CROSS-REFERENCE TO RELATED APPLICATIONS

This application is a continuation-in-part of U.S. application Ser. No. 15/252794 filed 31 Aug. 2016 entitled TWIST-ACTION PORTION-CONTROL SAUCE DISPENSER, which claims the benefit under 35 U.S.C. § 119 of U.S. Application No. 62/361688 filed 13 Jul. 2016 entitled TWIST-ACTION PORTION-CONTROL SAUCE DISPENSER, both of which are hereby incorporated herein by reference for all purposes.

FIELD

This invention relates to dispensers for flowable materials. The invention has particular application to dispensers used in food preparation. Embodiments provide portion-control sauce dispensers and associated methods.

BACKGROUND

Portion-control sauce dispensers are often used in fast food-type and other restaurants. Portion-control dispensers have the advantage over conventional "squeeze bottles" of always dispensing the same amount of sauce (e.g. ketchup, mustard, mayonnaise, etc.) with each use (for example, ½ fl. oz., ¼ fl. oz., etc.), thereby ensuring consistency in food preparation.

One type of portion-control dispenser uses a notched rod which is advanced incrementally each time a trigger is squeezed. Rod-type dispensers have the disadvantage of being relatively long and heavy. This limits the manner and location in which such dispensers can be used and stored, which can lead to inefficiency in food preparation. Efficient use of space in food preparation areas can be very important.

In order to address the problems discussed above, the present invention provides rodless portion-control dispensers.

SUMMARY

This invention has a number of aspects. One aspect provides dispensers for flowable materials such as sauces. The dispensers may be operable to repeatably dispense a uniform amount of sauce or other flowable material. Another aspect provides methods for dispensing sauces and other flowable materials. Another aspect provides component parts and sub-assemblies of apparatus for dispensing flowable materials. The following are some non-limiting enumerated example embodiments of the invention:

1. A dispenser useful for dispensing portions of a flowable material, the dispenser comprising:
   - a tubular body formed with at least one slot extending longitudinally along the body;
   - a piston disposed inside the body and movable along the body in a first direction toward a dispensing end of the body;
   - a ratchet mechanism operatively associated between the piston and the body, the ratchet mechanism preventing movement of the piston in a second direction opposite to the first direction; and
   - a piston-actuation mechanism coupled to apply a force sufficient to advance the piston in the first direction by way of the at least one slot, the piston-actuation mechanism comprising an anchoring part and a piston driving part coupled to the anchoring part, the anchoring part comprising a locking member movable between a released position wherein the anchoring part is movable along the body and an engaged position wherein an engagement feature of the locking member mechanically engages a corresponding feature of the body to restrict motion of the anchoring part in the second direction, the piston driving part acting between the anchoring part and the piston by way of the slot and comprising a member movable relative to the anchoring part between a first position and a second position wherein movement of the member from the first position to the second position when the locking member is in the engaged position incrementally advances the piston along the body in the first direction.
2. A dispenser according to enumerated example embodiment 1 wherein the locking member comprises a grip ring extending circumferentially around the body and the piston driving part comprises a cam ring rotatable relative to the grip ring, the cam ring comprising a cam surface arranged to displace the piston on rotation of the cam ring.
3. A dispenser according to enumerated example embodiment 2 wherein the cam surface is arranged to engage a cam follower carried by the piston.
4. A dispenser according to enumerated example embodiment 3 wherein the cam follower is on an arm projecting through the slot.
5. A dispenser according to any one of enumerated example embodiments 3-4 wherein the cam follower projects into a sloping slot or groove defined in the cam ring and the cam surface is provided by an edge of the sloping slot or groove.
6. A dispenser according to any one of enumerated example embodiments 2-5 comprising a spring coupled between the grip ring and the cam ring such that rotation of the cam ring urges the grip ring to rotate until the engagement feature of the locking member mechanically engages the corresponding feature of the body and continued rotation of the cam ring is permitted by extension or compression of the spring.
7. A dispenser according to any one of enumerated example embodiments 3-5 wherein the body is formed to provide at least three slots, the piston comprises at least three arms, each of the at least three arms extending into one of the at least three slots, and the cam ring comprises plural cam surfaces disposed to longitudinally displace corresponding cam followers on corresponding ones of the at least three arms.
8. A dispenser according to enumerated example embodiment 7 wherein the at least three slots are evenly spaced apart around a circumference of the body.
9. A dispenser according to enumerated example embodiment 7 wherein the at least three slots are angularly spaced apart from one another by 120 degrees.
10. A dispenser according to any one of enumerated example embodiments 7-9 comprising an arm structure that is attached to and rotatable relative to the piston wherein the at least three arms extend from the arm structure.
11. A dispenser according to enumerated example embodiment 10 wherein the body is formed to provide a row of teeth spaced apart along the body and the ratchet mechanism comprises a ratchet tooth carried on the arm structure and biased into engagement with the teeth on the body.

12. A dispenser according to enumerated example embodiment 11 wherein the teeth on the body are formed along one edge of each of the at least three slots.
13. A dispenser according to any one of enumerated example embodiments 11-12 comprising a spring in the piston, the spring biasing the arm structure to rotate relative to the piston in a direction to bring the ratchet tooth into engagement with the teeth on the body.
14. A dispenser according to any one of enumerated example embodiments 11-13 wherein the engagement feature of the locking member comprises a tooth arranged to mechanically engage the teeth on the body.
15. A dispenser according to any one of enumerated example embodiments 1-10 wherein the body is formed to provide a row of teeth spaced apart along the body and the ratchet mechanism comprises a ratchet tooth connected to the piston and biased into engagement with the teeth on the body.
16. A dispenser according to enumerated example embodiment 15 wherein the teeth on the body are formed along one edge of the slot.
17. A dispenser according to enumerated example embodiment 16 comprising a piston return track formed inside a bore of the body, the piston return track extending along the slot on a side of the slot opposed to the teeth from a first opening proximate a first end of the slot to a second opening proximate a second end of the slot wherein the ratchet mechanism comprises a return tongue coupled to the ratchet tooth and the ratchet tooth connected to the piston is held out of engagement with the teeth on the body when the return tongue is received within the piston return track.
18. A dispenser according to any one of enumerated example embodiments 15-17 wherein a travel distance of the piston when actuated by the piston driving part is equal to or a multiple of a distance that the teeth on the body are spaced apart from one another.
19. A dispenser according to any one of enumerated example embodiments 1-18 comprising one or more guide tracks extending longitudinally inside a bore of the body and one or more guide tongues projecting from the piston into the guide tracks, wherein engagement of the guide tongues in the guide tracks limits rotation of the piston in the body.
20. A dispenser according to any one of enumerated example embodiments 1-19 comprising a pouch contained within the body, the pouch containing a material to be dispensed.
21. A dispenser according to any one of enumerated example embodiments 1-20 wherein an end of the piston facing in the first direction comprises a plurality of spaced-apart ribs.
22. A dispenser according to enumerated example embodiment 21 wherein the ribs radiate outwardly.
23. A dispenser according to any one of enumerated example embodiments 1-22 comprising a dispenser cap coupled to the dispensing end of the body, the dispenser cap comprising one or more nozzles.
24. A dispenser according to enumerated example embodiment 23 wherein the nozzles are pressure actuated.
25. A dispenser according to any one of enumerated example embodiments 23-24 wherein the dispenser cap is removably attached to the dispensing end of the body.
26. A dispenser according to any one of enumerated example embodiments 1-25 wherein the piston-actuation mechanism is located longitudinally entirely between the ends of the body.
27. A dispenser according to any one of enumerated example embodiments 1-26 comprising bearings mounted on the piston-actuation mechanism, the bearings facilitating longitudinal motion of the piston-actuation mechanism relative to the body when the locking member is in the released position.
28. A dispenser comprising:
a tubular dispenser body having a first end and a second end;
a piston movably disposed within the dispenser body;
means for dispensing a flowable material from the second end of the dispenser body;
an anchor means movable along an outside of the dispenser body;
a piston-actuation mechanism comprising:
locking means for releasably holding the anchor means at a longitudinal position along the dispenser body; and
piston-driving means for incrementally advancing the piston toward the second end of the dispenser body relative to the anchor means while the anchor means is held by the locking means.

In different embodiments the piston driving means may comprise a ramp, cam surface, linkage, lever, jack, or screw that incrementally moves the piston relative to the anchor means, when actuated. In different embodiments the locking means comprises one or more teeth, pins, a clamp, a brake, a detent, a pawl or the like that can hold the anchor means in place against forces exerted by the piston driving means when the piston-driving means is actuated.

29. A dispenser according to enumerated example embodiment 28 comprising a rotatable grip, means for actuating the locking means when the rotatable grip is rotated relative to the dispenser body and means for actuating the piston-driving means in response to further rotation of the rotatable grip.
30. A method for dispensing flowable material, the method comprising:
anchoring a mechanism provided on an external surface of a hollow dispenser body of a dispenser to the body;
advancing a piston contained within the body relative to the mechanism, such that the piston
advances one increment along the body;
releasing the mechanism from the body; and
allowing the mechanism to advance relative to the body by a distance corresponding to the incremental movement of the piston.
31. A dispenser for dispensing flowable materials, the dispenser comprising:
a dispenser body having a first end and a second end, the second end opposing the first end along
a longitudinal direction defined by the dispenser body;
a grip ring supported on an exterior surface of the dispenser body; and
a piston movably fitted within the dispenser body and coupled to the grip ring;
wherein the grip ring is rotatable relative to the dispenser body and comprises a surface acting on the coupling to the piston to incrementally advance the piston through the dispenser body along the longitudinal direction towards the second end when the grip ring is rotated relative to the dispenser body.
32. A dispenser according to enumerated example embodiment 31 wherein the dispenser body comprises one or more slots through a wall of the dispenser body extending along the longitudinal direction and the coupling between the grip ring and the piston extends through one or more of the slots.
33. A dispenser according to enumerated example embodiment 32 wherein each of the one or more slots comprises a toothed rack extending along one edge of the respective slot, each toothed rack comprising a plurality of teeth.

34. A dispenser according to enumerated example embodiment 33 wherein each of the plurality of teeth has a sawtooth profile.

35. A dispenser according to any one of enumerated example embodiments 33-34 wherein the piston comprises one or more driven arms, each of the driven arms comprising a cam follower projecting through a corresponding one of the one or more slots.

36. A dispenser according to enumerated example embodiment 35 wherein the grip ring comprises one or more cam surfaces, the cam surfaces each aligned to engage a corresponding one of the cam followers.

37. A dispenser according to enumerated example embodiment 36 wherein the grip ring is divided into one or more portions, each portion comprising one of the cam surfaces.

38. A dispenser according to any one of enumerated example embodiments 35-37 wherein each of the one or more cam followers extends radially away from the piston, through the corresponding slot.

39. A dispenser according to any one of enumerated example embodiments 36-37 wherein each of the one or more cam surfaces is generally linear and sloped to move the respective cam follower along the longitudinal direction towards the second end of the dispenser body when the grip ring is rotated relative to the dispenser body.

40. A dispenser according to any one of enumerated example embodiments 33-39 wherein each of the one or more driven arms comprises a tooth engageable with a corresponding one of the plurality of teeth on the toothed rack of the respective slot.

41. A dispenser according to enumerated example embodiment 40 wherein the grip ring and the piston are constrained from movement in the longitudinal direction toward the first end of the dispenser body when the tooth of one or more of the driven arms is engaged with one of the plurality of teeth of the respective toothed rack.

42. A dispenser according to any one of enumerated example embodiments 40-41 wherein the teeth of the one or more toothed racks are profiled to disengage the tooth on a corresponding one of the driven arms from a first of the plurality of teeth and engage with a second of the plurality of teeth, the second of the plurality of teeth being relatively closer to the second end of the dispenser body, when the grip ring is rotated relative to the dispenser body.

43. A dispenser according to any one of enumerated example embodiments 33-42 wherein the length of incremental movement of the piston through the dispenser body corresponds to the size of each of the plurality of teeth of each of the one or more toothed racks.

44. A dispenser according to enumerated example embodiment 36 wherein the number of slots, driven arms, and cam surfaces is three.

45. A dispenser according to any one of enumerated example embodiments 31-44 comprising a pouch contained within the dispenser body, the pouch containing a material to be dispensed.

46. A dispenser according to enumerated example embodiment 45 comprising a dispenser cap coupled to the second end of the dispenser body, the dispenser cap comprising one or more nozzles wherein the nozzles are optionally pressure actuated.

47. A dispenser according to enumerated example embodiment 46 wherein the dispenser cap is removably attachable to the second end of the dispenser body.

48. A dispenser according to enumerated example embodiment 47 wherein the pouch is compressed as the piston is advanced through the dispenser body.

49. A dispenser according to any one of enumerated example embodiments 46-48 wherein the pouch contains a sauce and the sauce is expelled from the sauce pouch through the dispenser cap as the sauce pouch is compressed.

50. A dispenser according to any one of enumerated example embodiments 31-49 comprising one or more tracks on an interior surface of the dispenser body extending along the longitudinal direction from the first end to the second end.

51. A dispenser according to enumerated example embodiment 50 wherein each of the one or more tracks comprises a wall extending along one edge of the track, each wall having a first end and a second end, a longitudinal length between the first and second ends being shorter than a longitudinal length of the dispenser body.

52. A dispenser according to enumerated example embodiment 51 wherein each wall comprises first and second breaks, the first break formed between the first end of the wall and the first end of the dispenser body, the second break formed between the second end of the wall and the second end of the dispenser body.

53. A dispenser according to enumerated example embodiment 52 wherein the piston comprises one or more tongues, each of the one or more tongues engageable with a corresponding one of the tracks.

54. A dispenser according to enumerated example embodiment 53 wherein each of the one or more tongues enters the respective track through the second break in the respective wall when the grip ring is rotated relative to the dispenser body.

55. A dispenser according to any one of enumerated example embodiments 53-54 wherein each of the one or more tongues leaves the respective track through the first break in the respective wall when the piston is advanced through the dispenser body to the first end of the dispenser body.

56. A dispenser according to any one of enumerated example embodiments 53-55 wherein the number of tracks and tongues is three.

57. A dispenser according to any of the above example enumerated embodiments comprising a bias mechanism coupled between an anchoring part and the piston, the bias mechanism comprising a deformable member that applies a forward-directed force to the anchoring part in response to forward displacement of the piston relative to the anchoring part.

58. A dispenser useful for dispensing portions of a flowable material, the dispenser comprising: a tubular body formed with at least one slot extending longitudinally along the body; a piston disposed inside the body and movable along the body in a first direction toward a dispensing end of the body; a ratchet operatively associated between the piston and the body, the ratchet mechanism preventing movement of the piston in a second direction opposite to the first direction; and a piston-actuation mechanism coupled to apply a force sufficient to advance the piston in the first direction by way of the at least one slot, the piston-actuation mechanism comprising an anchoring part and a piston driving part coupled to the anchoring part, the anchoring part comprising a locking member movable between a released position wherein the anchoring part is movable along the body and an engaged position wherein an engagement feature of the locking member mechanically engages a corresponding feature of the body to restrict motion of the anchoring part in the second direction, the piston driving part acting between the anchoring part and the piston by way of the slot and comprising a member movable relative to the anchoring part between a first position and a second position wherein movement of the member from the first position to the second position when the locking member is in the engaged position incrementally advances the piston along the body in the first direction; and a bias mechanism coupled between the anchoring part and the piston, the bias mechanism comprising a deformable member that applies a force to the anchoring part directed in the first direction in response to motion of the piston in the first direction relative to the anchoring part.

59. A dispenser according to enumerated example embodiment 58 wherein the locking member comprises a grip ring extending circumferentially around the body and the piston driving part comprises a cam ring rotatable relative to the grip ring, the cam ring comprising a cam surface arranged to displace the piston on rotation of the cam ring.

60. A dispenser according to enumerated example embodiment 58 or 59 wherein the deformable member comprises one or more compression springs located between a first member coupled to the piston and a second member engaging the anchoring part.

61. A dispenser according to enumerated example embodiment 60 wherein the slot is one of a plurality of longitudinally-extending slots in the wall of the body, the first member comprises a backing plate rigidly coupled to the piston and the second member comprises a spring plate having fingers that project through the slots in the wall of the body to engage the anchoring part.

62. A dispenser according to any one of enumerated example embodiments 58 to 61 wherein the cam surface is arranged to engage a cam follower carried by the piston.

63. A dispenser according to enumerated example embodiment wherein the cam surface is one of at least three cam surfaces carried by the cam ring and the cam follower is one of a plurality of cam followers, each of the cam followers comprising an arm projecting through one of the slots.

64. A dispenser according to enumerated example embodiment 63 wherein each of the cam followers projects into a sloping slot or groove defined in the cam ring and each of the cam surfaces is provided by an edge of a corresponding one of the sloping slots or grooves.

65. A dispenser according to enumerated example embodiment 64 wherein the body is formed to provide at least three slots, the piston comprises at least three arms, each of the at least three arms extending into one of the at least three slots, and the cam surfaces of the cam ring include plural cam surfaces disposed to longitudinally displace corresponding cam followers on corresponding ones of the at least three arms.

66. A dispenser according to enumerated example embodiment 65 wherein the at least three slots are evenly spaced apart around a circumference of the body.

67. A dispenser according to any one of example enumerated embodiments 58 to 66 wherein the body is formed to provide a row of teeth spaced apart along the body and the ratchet comprises a ratchet tooth carried with the piston and biased into engagement with the teeth on the body.

68. A dispenser according to enumerated example embodiment 67 wherein the teeth on the body comprise teeth formed along one edge of each of the at least three slots.

69. A dispenser according to any one of example enumerated embodiments 58 to 68 wherein the engagement feature of the locking member comprises a tooth arranged to mechanically engage the teeth on the body.

70. A dispenser according to any one of example enumerated embodiments 58 to 69 comprising a piston return track formed inside a bore of the body, the piston return track extending along the slot on a side of the slot opposed to the teeth from a first opening proximate a first end of the slot to a second opening proximate a second end of the slot wherein the ratchet comprises a return tongue coupled to the ratchet tooth and the ratchet tooth connected to the piston is held out of engagement with the teeth on the body when the return tongue is received within the piston return track.

71. A dispenser according to any one of example enumerated embodiments 67 and 68 wherein a travel distance of the piston when actuated by the piston driving part is equal to or a multiple of a distance that the teeth on the body are spaced apart from one another.

72. A dispenser according to any one of example enumerated embodiments 58 to 71 comprising one or more guide tracks extending longitudinally inside a bore of the body and one or more guide tongues projecting from the piston into the guide tracks, wherein engagement of the guide tongues in the guide tracks limits rotation of the piston in the body.

73. A dispenser according to any one of example enumerated embodiments 58 to 72 comprising a pouch contained within the body, the pouch containing a material to be dispensed.

74. A dispenser according to any one of example enumerated embodiments 58 to73 wherein the piston-actuation mechanism is located longitudinally entirely between the ends of the body.

75. A dispenser according to example enumerated embodiment 59 to comprising a spring coupled between the grip ring and the cam ring such that rotation of the cam ring urges the grip ring to rotate until the engagement feature of the locking member mechanically engages the corresponding feature of the body and continued rotation of the cam ring is permitted by extension or compression of the spring.

76. A dispenser according to any one of example enumerated embodiments 58 to 75 comprising one or more bearings mounted on the piston-actuation mechanism, the bearings facilitating longitudinal motion of the piston-actuation mechanism relative to the body when the locking member is in the released position.

77. A dispenser comprising: a tubular dispenser body having a first end and a second end; a piston movably disposed within the dispenser body; means for dispensing a flowable material from the second end of the dispenser body; an anchor means movable along an outside of the dispenser body; a piston-actuation mechanism comprising: locking means for releasably holding the anchor means at a longitudinal position along the dispenser body; and piston-driving means for incrementally advancing the piston toward the second end of the dispenser body relative to the anchor means while the anchor means is held by the locking means; and a bias means for urging the anchor means toward the second end of the dispenser body relative to the piston.

78. A dispenser according to example enumerated embodiment 77 comprising a rotatable grip, means for actuating the locking means when the rotatable grip is rotated relative to the dispenser body and means for actuating the piston-driving means in response to further rotation of the rotatable grip.

79. A method for dispensing a flowable material from a dispenser, the method comprising: placing a pouch containing the flowable material inside a body of a dispenser; incrementally advancing a piston in a forward direction to dispense corresponding portions of the flowable material by steps including: engaging an anchor to the body such that the anchor resists longitudinal movement relative to the body; applying a force between the anchor and the piston to advance the piston incrementally in the forward direction and to store energy in a deformable bias member; releasing the anchor from the body to allow the anchor to move longitudinally relative to the body and applying stored energy from the deformable bias member to incrementally move the anchor along the body in the forward direction.

Further aspects and example embodiments are illustrated in the accompanying drawings and/or described in the following description.

BRIEF DESCRIPTION OF THE DRAWINGS

The accompanying drawings illustrate non-limiting example embodiments of the invention.

FIGS. 10A-10E are schematic views of the engagement of driven arm and grip ring teeth with a toothed rack on the FIG. 2 dispenser body.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

Embodiments of the present invention provide dispensers for flowable materials in which a piston is advanced along a hollow dispenser body by a mechanism that engages the dispenser body and incrementally moves the piston along the dispenser body. In some embodiments the dispenser body is formed with one or more longitudinal slits and the mechanism transmits force to the piston by way of members that extend through the one or more longitudinal slits. No rod is required. The dispenser may be much shorter in length than a comparable rod-type dispenser.

Figure 1:
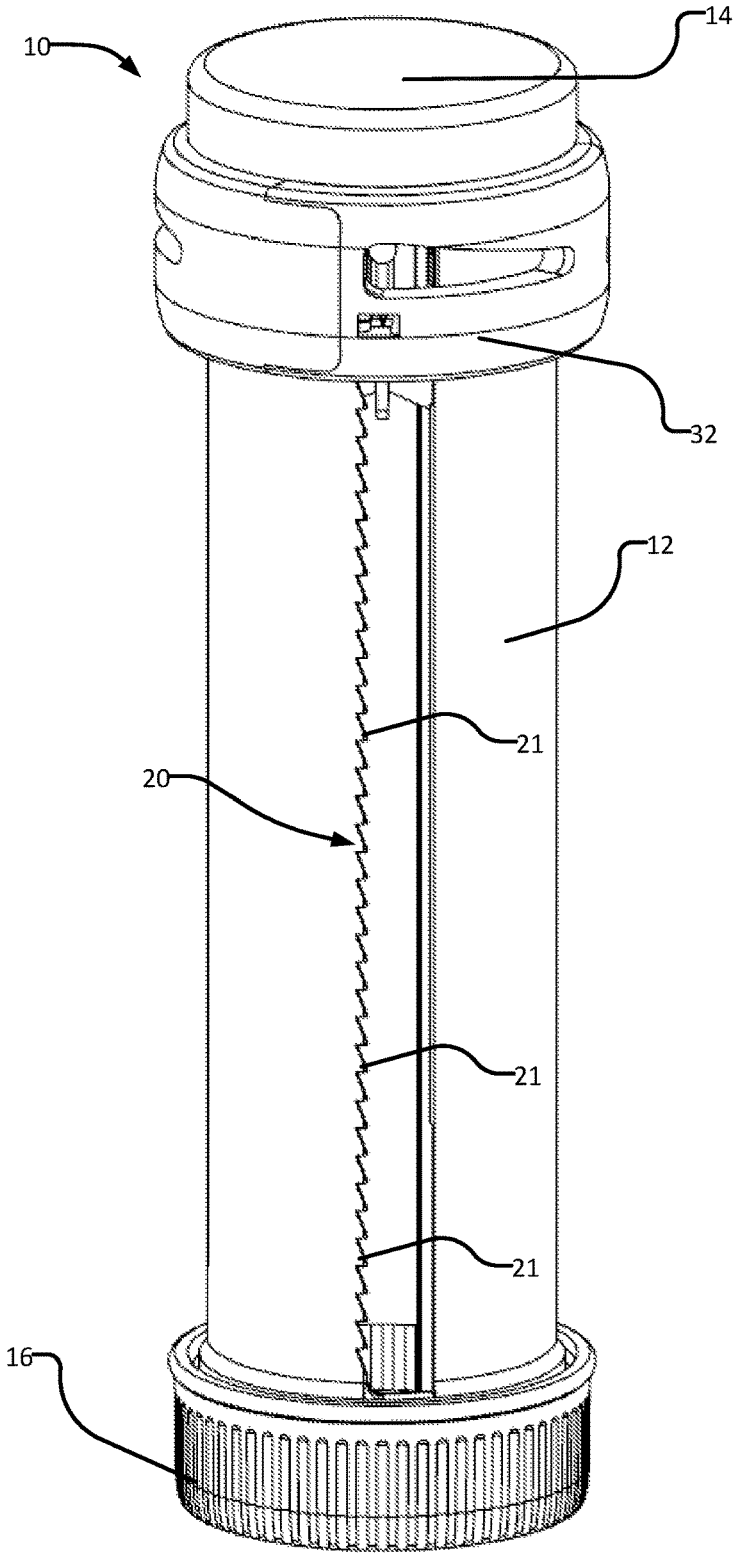
FIG. 1 is a front perspective view of a portion-control twist dispenser according to one embodiment of the invention.

A dispenser 10 according to a non-limiting example embodiment is illustrated in FIGS. 1 to 14. FIG. 1 is a front perspective view of twist dispenser 10. Dispenser 10 includes a dispenser body 12 having a hollow bore 12A and a piston 26 that is movable longitudinally along bore 12A.

Figure 2:
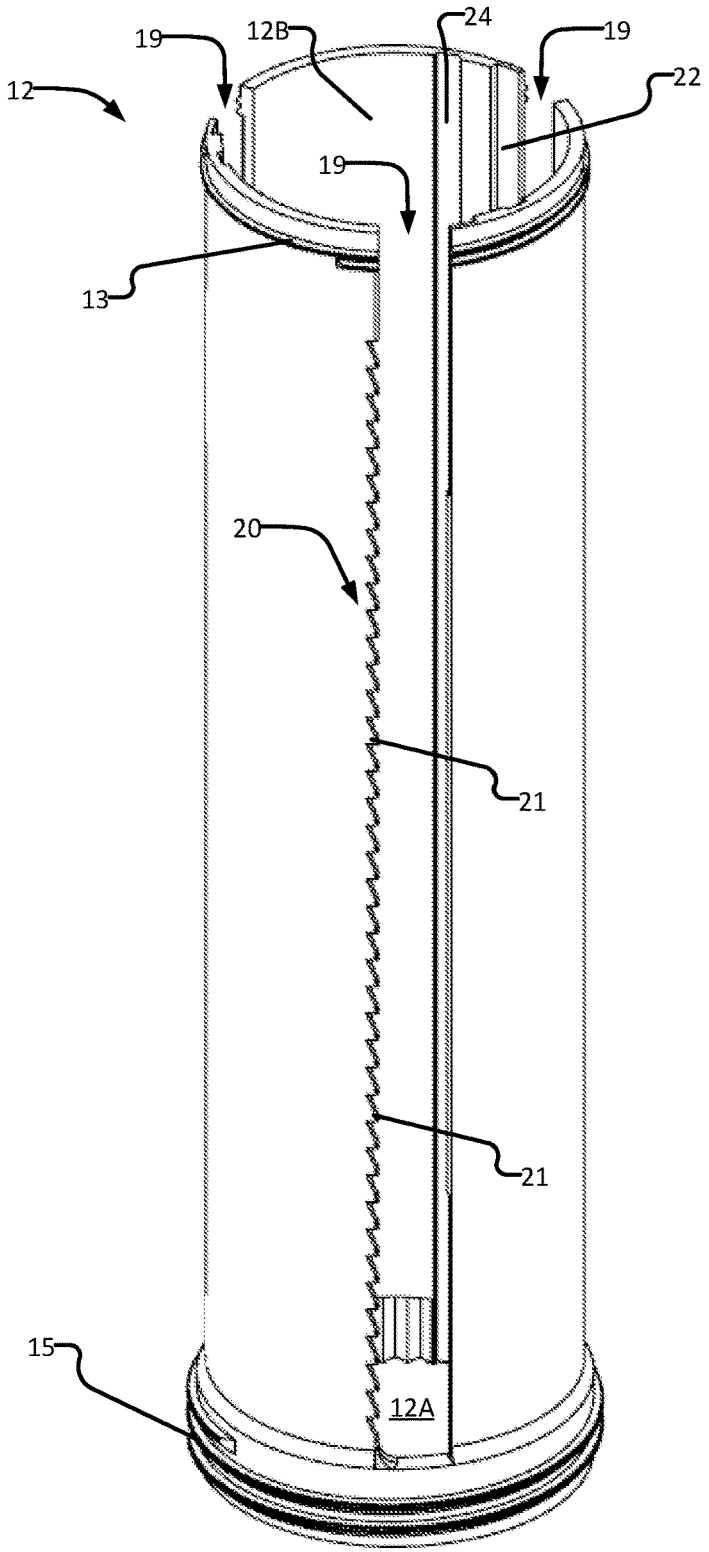
FIG. 2 is a perspective view of the dispenser body of the FIG. 1 twist dispenser.

In the illustrated embodiment, piston 26 is advanced by a mechanism 25 that engages dispenser body 12 and is operable to advance piston 26. Each time the mechanism is operated, the mechanism moves along dispenser body 12 by a predetermined incremental distance. At least part of the mechanism is outside of dispenser body 12. This part of the mechanism is coupled to piston 26 by a member that extends through a longitudinally extending slot 19 in dispenser body 12. FIG. 2 is a perspective view of an example open-ended, cylindrical dispenser body 12 which includes a plurality (three in this instance) of slots 19 that extend longitudinally along dispenser body 12.

This general configuration is capable of providing a structure that is short compared to rod-type dispensers. For example, a dispenser with this configuration may have a three dimensional envelope which is not much different from that of a conventional squeeze bottle of similar capacity.

Piston 26 comprises cam followers 34 that project into slots 19 which extend along body 12. Mechanism 25, which is operative to advance piston 26, comprises an anchoring part that serves to anchor mechanism 25 to body 12 so that mechanism 25 can push on cam followers 34. The anchoring part may be releasable such that it engages body 12 only when mechanism 25 is being operated. The anchoring part may be freely slidable along body 12 when mechanism 25 is not being operated.

Mechanism 25 also comprises a piston-driver part or assembly that is operative to force piston 26 along dispenser body 12 when the anchoring part is engaged to anchor mechanism 25 to body 12. It is convenient for the piston-driver to be operated by a continuation of the same motion by which the anchoring part is engaged (e.g. a twisting motion).

Dispenser 10 shown in FIG. 1 includes a top cap 14 and a dispenser cap 16. Dispenser cap 16 may include one or more dispensing openings or nozzles (not shown). In some embodiments, dispenser cap 16 includes one or more pressure-actuated nozzles which automatically open when a flowable material is under sufficient pressure and automatically close when the pressure of the flowable material falls to below a threshold pressure. Pressure actuated nozzles that are suitable for culinary uses are commercially available.

A pouch containing material to be dispensed may be inserted into dispenser body 12 by removing dispenser cap 16, inserting the pouch, and replacing dispenser cap 16. The pouch may optionally be constructed to have a flange on one end which may be trapped between dispenser body 12 and dispenser cap 16 in order to secure the pouch within dispenser body 12 and to hold a dispensing end of the pouch relatively taut.

Dispenser body 12 may include couplings for removably attaching top cap 14 and dispenser cap 16. The couplings may comprise, for example, threads, bayonet couplings, snap couplings, or the like. The illustrated embodiment provides helical top cap threads 13 and dispenser cap threads 15, which may interact with corresponding threads in top cap 14 and dispenser cap 16, respectively. With this construction top cap 14 and dispenser cap 16 may each be removably attached to dispenser body 12 via a screw connection.

In dispenser 10, the anchoring part of mechanism 25 is provided by grip ring 30, which extends circumferentially around dispenser body 12. Grip ring 30 carries engagement members which are configured to engage teeth 21 on dispenser body 12. For example, FIG. 2 shows toothed racks 20 which provide teeth 21. Racks 20 each extend along one side of a corresponding slot 19. The engagement members may, for example, be provided by one or more teeth 46 configured to engage teeth 21. In the illustrated embodiment, grip ring 30 includes three circumferentially-spaced teeth 46 (see FIG. 7) which are spaced apart to engage teeth 21 of racks 20 (see FIG. 2).

Figure 8:
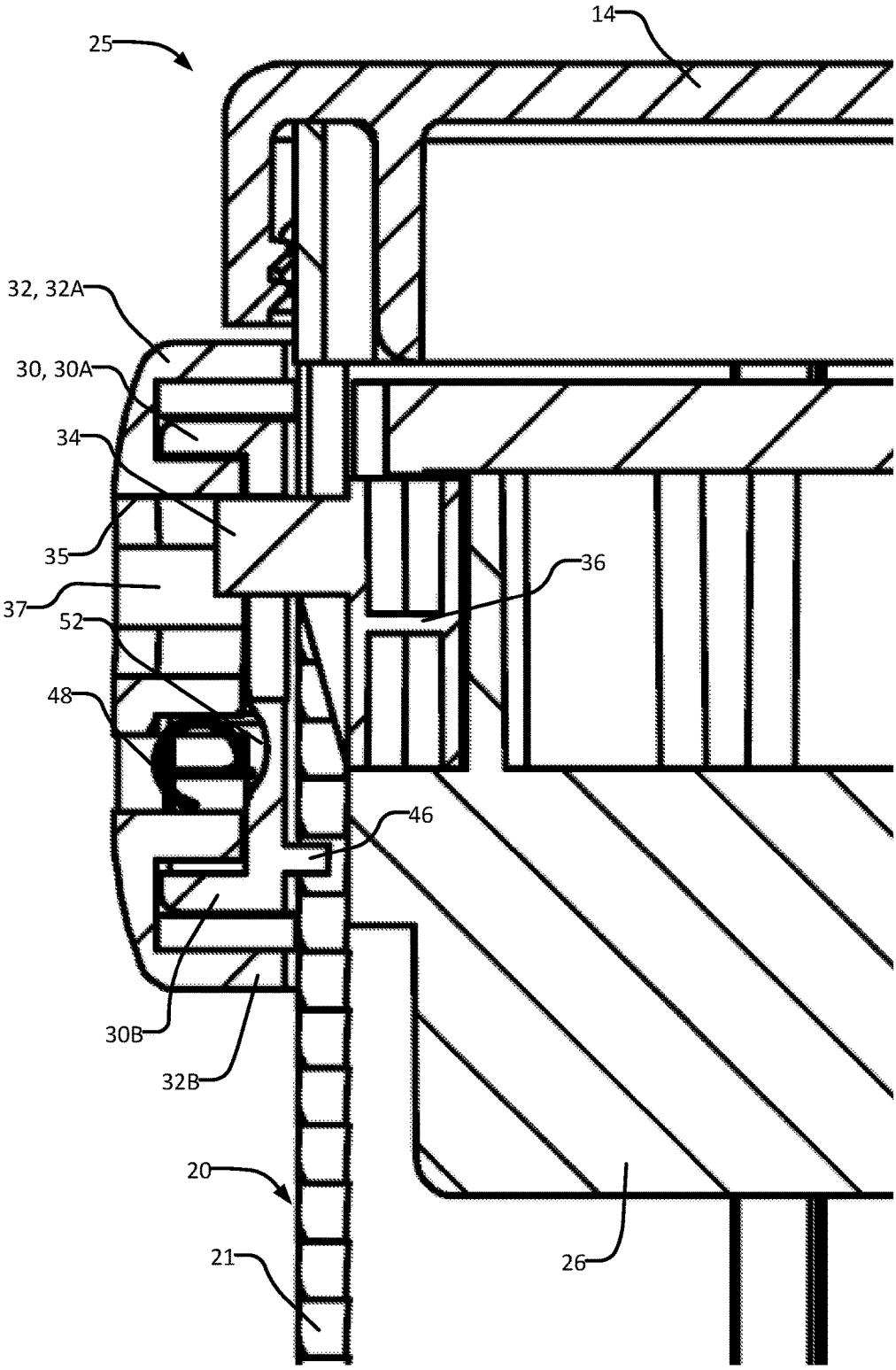
FIG. 8 is a close-up cross sectional front view of part of the FIG. 3 grip ring and piston mechanism.
Figure 9:
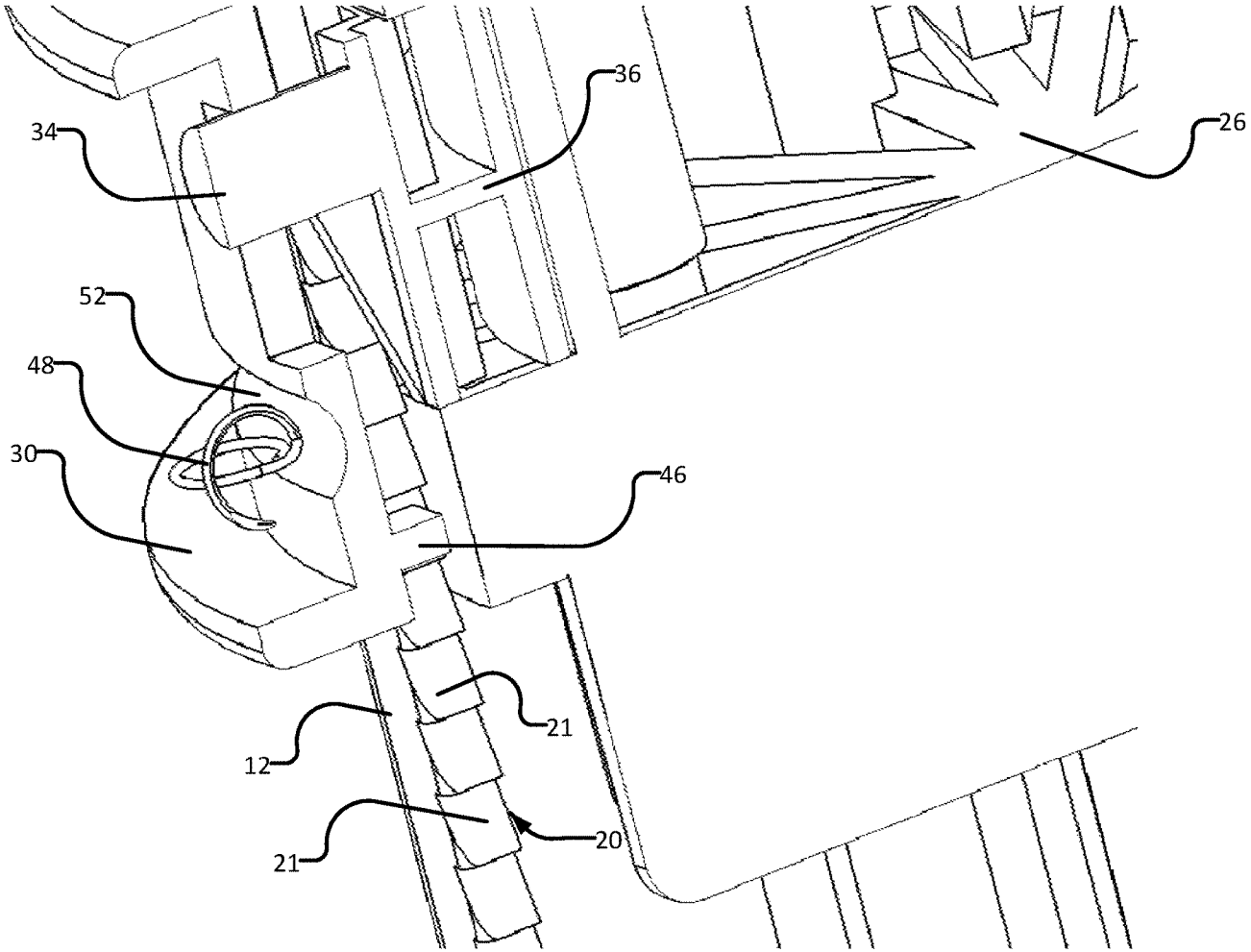
FIG. 9 is a rotated view of the assembly of FIG. 8 without the cam ring.

Teeth 46 of grip ring 30 may extend radially inwardly into a respective longitudinal slot 19 on dispenser body 12 (see FIGS. 8 and 9). Grip ring 30 can be rotated relative to body 12 between a first, disengaged, rotational position in which the engagement members are disengaged from teeth 21 and a second, anchored, position wherein the engagement members are engaged with teeth 21. While grip ring 30 is in a start position (i.e. when no external forces are placed on grip ring 30), as shown in FIG. 1, teeth 46 of grip ring 30 are not engaged with teeth 21 of toothed racks 20 (see FIG. 10A).

In the anchored position grip ring 30 is prevented from moving back toward top cap 14. In some embodiments grip ring 30 is biased relative to teeth 21 so that the engagement members are disengaged from teeth 21 when no external forces are acting on grip ring 30. In some embodiments grip ring 30 is free to rotate relative to body 12 between the disengaged and anchored rotational positions.

In the illustrated embodiment, the piston-driver comprises cam surfaces 35 that engage cam followers 34 on driven arms 36. Moving cam surfaces 35 relative to cam followers 34 applies a force to move driven arms 36 towards dispenser cap 16. Cam surfaces 35 are configured to provide a desired incremental displacement of piston 26 toward dispenser cap 16. In the illustrated embodiment, cam surfaces 35 are carried on a cam ring 32 that is rotatable relative to grip ring 30. The outer surface of cam ring 32 may be textured to facilitate a user gripping and turning cam ring 32 relative to body 12.

A ratchet mechanism allows piston 26 to move toward dispenser cap 16 and prevents piston 26 from moving back toward top cap 14. The ratchet mechanism is configured to hold piston 26 at the incremental displacements achieved by mechanism 25. In some embodiments the ratchet mechanism comprises a tooth or pawl that engages teeth 21. In some embodiments teeth 21 have a pitch that matches the incremental displacement of piston 26 such that the ratchet mechanism advances by one tooth 21 along rack 20 for each actuation of mechanism 25.

Figure 5:
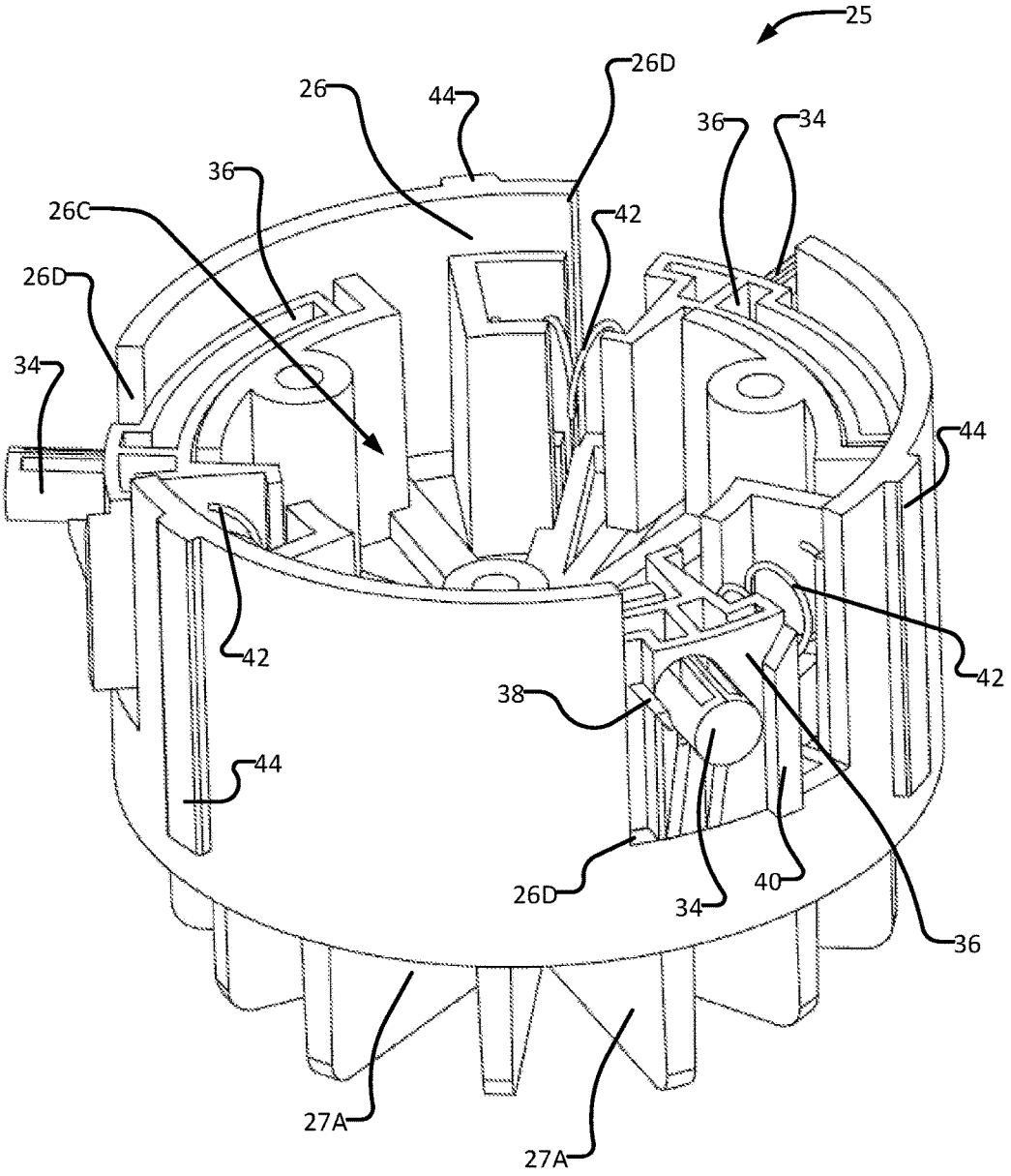
FIG. 5 shows the assembly of FIG. 4 without the grip ring and upper part of the piston.
Figure 6:
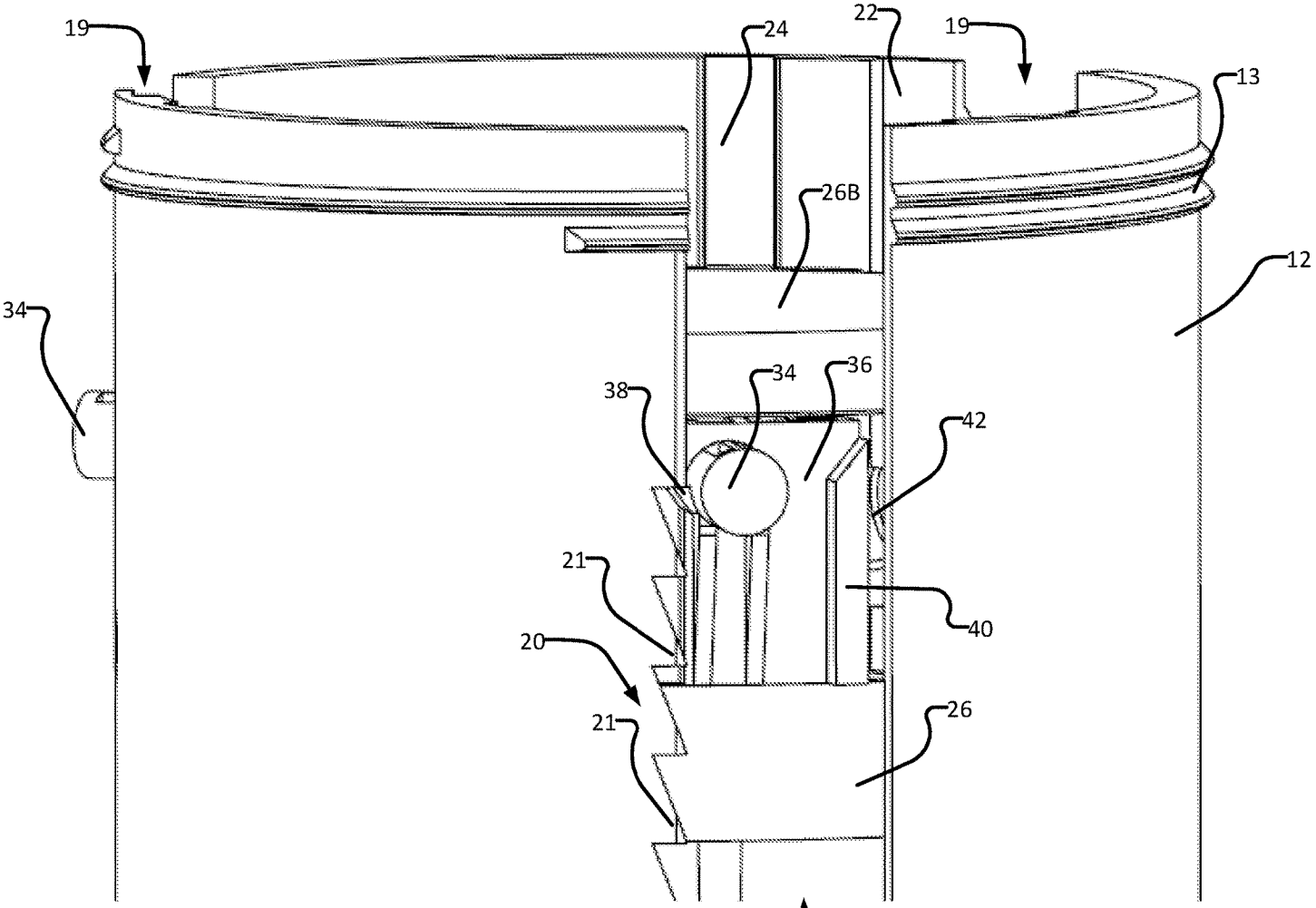
FIG. 6 is a perspective view of the FIG. 1 twist dispenser showing the interaction between the tooth of a driven arm and a toothed rack.

An example ratchet mechanism is shown in FIG. 5, which shows mechanism 25 with grip ring 30 removed. In this embodiment piston 26 includes longitudinal tongues 44 which each engage a respective guide track 24 on an inner surface 12B of dispenser body 12 (see FIG. 2). This engagement between longitudinal tongues 44 and guide tracks 24 is shown in more detail in FIG. 11. The engagement of tongues 44 in tracks 24 constrains rotation of piston 26 relative to body 12. In some embodiments, there may be very little rotational movement of piston 26 relative to dispenser body 12.

The ratchet mechanism comprises teeth 38 which are mounted on driven arms 36, which are rotatable relative to piston 26. Driven arms 36 are biased (e.g. by compression springs 42) to bring teeth 38 into engagement with racks 20. This biasing force causes teeth 38 to engage with teeth 21 on dispenser body 12. The engagement of teeth 38 with teeth 21 is shown in greater detail in FIG. 6. Teeth 21 and 38 are shaped such that piston 26 and driven arms 36 can be moved toward dispenser cap 16 but cannot be moved in the opposite direction as long as teeth 38 are engaged with corresponding racks 20.

As described in greater detail below, dispenser 10 may be configured such that rotating cam ring 32 relative to dispenser body 12 causes mechanism 25, which includes piston 26 inside dispenser body 12, to move incrementally along body 12 away from top cap 14 and toward dispenser cap 16. In this manner, piston 26 can be advanced incrementally. Each time piston 26 is advanced, a predetermined quantity of a flowable material (e.g. a sauce) is dispensed through dispenser cap 16.

As mechanism 25 moves incrementally toward dispenser cap 16, piston 26 (shown in FIG. 3) may place pressure on a material (e.g. sauce) in a pouch contained within dispenser body 12. This pressure may cause sauce (or another flowable material) to be dispensed from the pouch out of dispenser cap 16.

It is convenient for the piston-driver to be operated by a continuation of the same motion by which the anchoring part is engaged. Preferably cam surfaces 35 and grip ring 30 are configured such that for the same direction of rotation relative to body 12, grip ring 30 is rotated into the anchored position and cam ring 32 pushes piston 26 toward dispenser cap 16. This rotational direction may be called an 'actuation' direction. Grip ring 30 may be coupled to cam ring 32 by a resilient coupling, such as a spring, for example, such that turning cam ring 32 in the actuation direction brings grip ring 30 to its anchored position and then allows cam ring 32 to continue turning until cam surfaces 35 have advanced piston 26 by one full increment.

Figure 7:
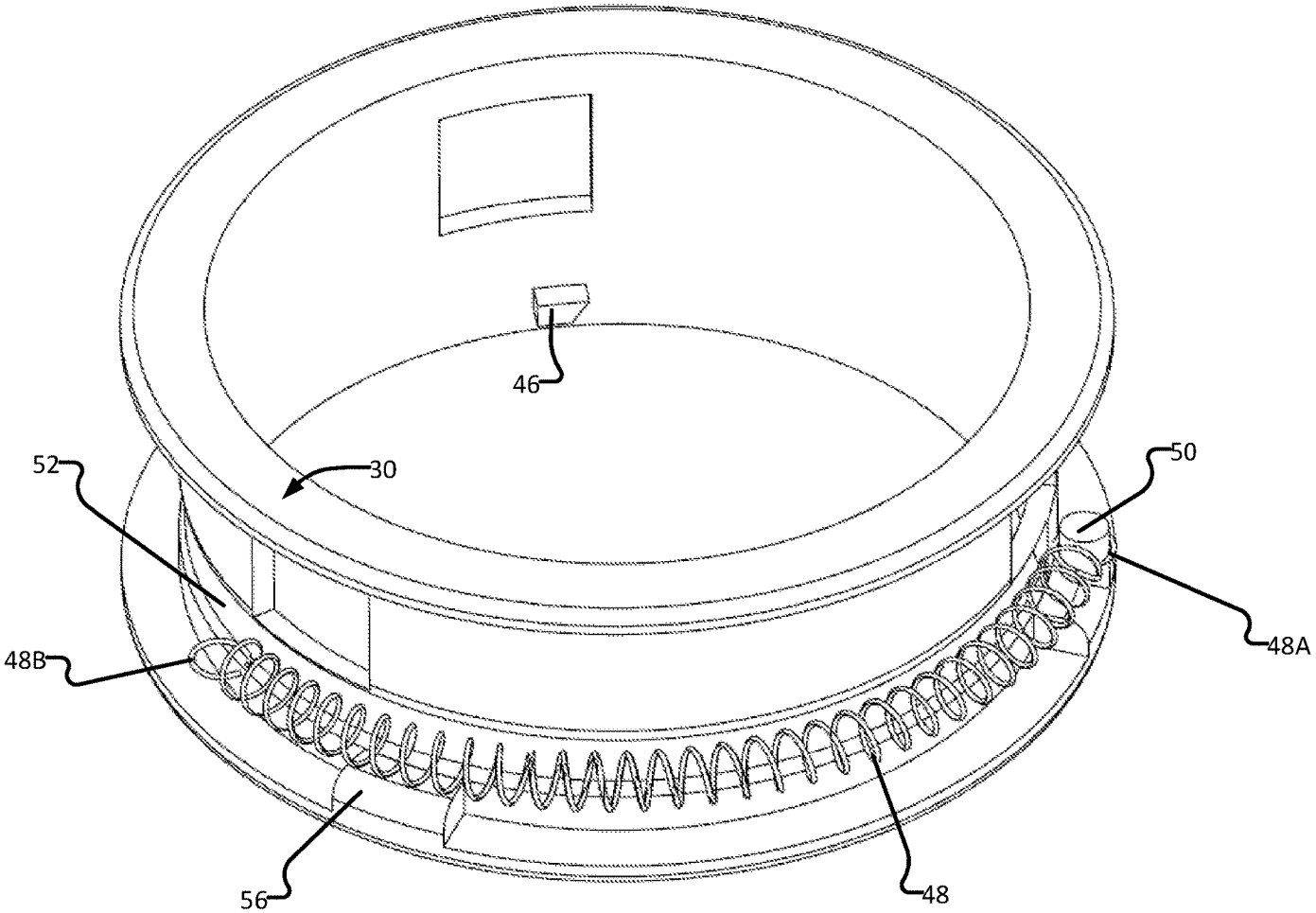
FIG. 7 is a perspective view of the grip ring with an extension spring.

In the illustrated embodiment an extension spring 48 couples cam ring 32 and grip ring 30. As seen in FIG. 7, extension spring 48 extends along a spring groove 52 defined between grip ring 30 and cam ring 32. Spring 48 is anchored to grip ring 30 at one end 48A (e.g. by a post 50) and to cam ring 32 at an opposite end 48B.

As discussed above, cam ring 32 may be biased to rotate relative to grip ring 30. Grip ring 30 and cam ring 32 may have one or more boss features 56 which stop against one another when dispenser 10 is not in use, in order to keep tension in spring 48 or another resilient bias mechanism. In this way, grip ring 30 and cam ring 32 are automatically returned to a start rotational position relative to one another when dispenser 10 is not in use.

The amount of sauce or other flowable material to be dispensed with each incremental movement of piston 26 may be predetermined by the shape of cam surfaces 35 and the range of motion of cam ring 32. In some embodiments, 4 to 30 mL of sauce may be dispensed with each incremental movement of piston 26 toward dispenser cap 16. In an example embodiment six mL (~⅕ fl. oz.) of sauce is dispensed with each incremental movement of piston 26 toward dispenser cap 16.

Dispenser 10 may be constructed to facilitate return of piston 26 to a starting position after piston 26 has reached its closest approach to dispenser cap 16. One way to achieve this is illustrated in the Figures. A piston return track 22 is provided on inner surface 12B of dispenser body 12 adjacent to each slot 19. A break 23A in one wall 23 of piston return tracks 22 at an end nearest to dispenser cap 16 extends into a slot 19 on its side away from rack 20. Breaks 23A provide paths for longitudinal tongues 40 on driven arms 36 to enter their respective piston return tracks 22. In doing so, teeth 38 are disengaged from the corresponding racks 20. This releases the ratchet mechanism such that mechanism 25 can be slid toward top cap 14. Tongues 40 may be caused to enter the corresponding piston return tracks 22 by way of breaks 23A by rotating cam ring 32 in a direction opposite to the actuation direction. This rotation pushes cam followers 34 toward breaks 23A against the bias force provided, for example, by springs 42.

Figure 3:
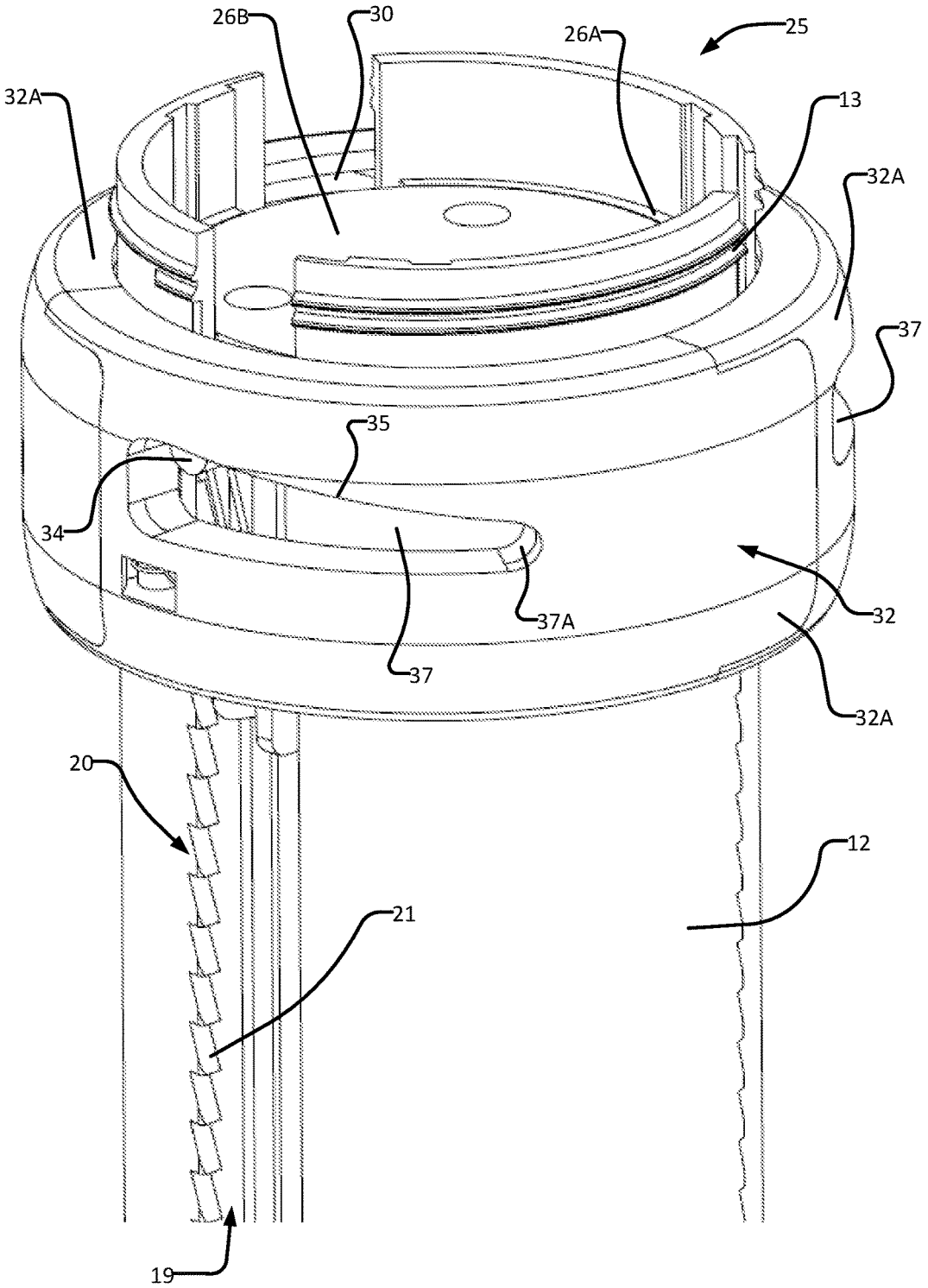
FIG. 3 is a perspective view of the grip ring and piston mechanism of the FIG. 1 twist dispenser.
Figure 4:
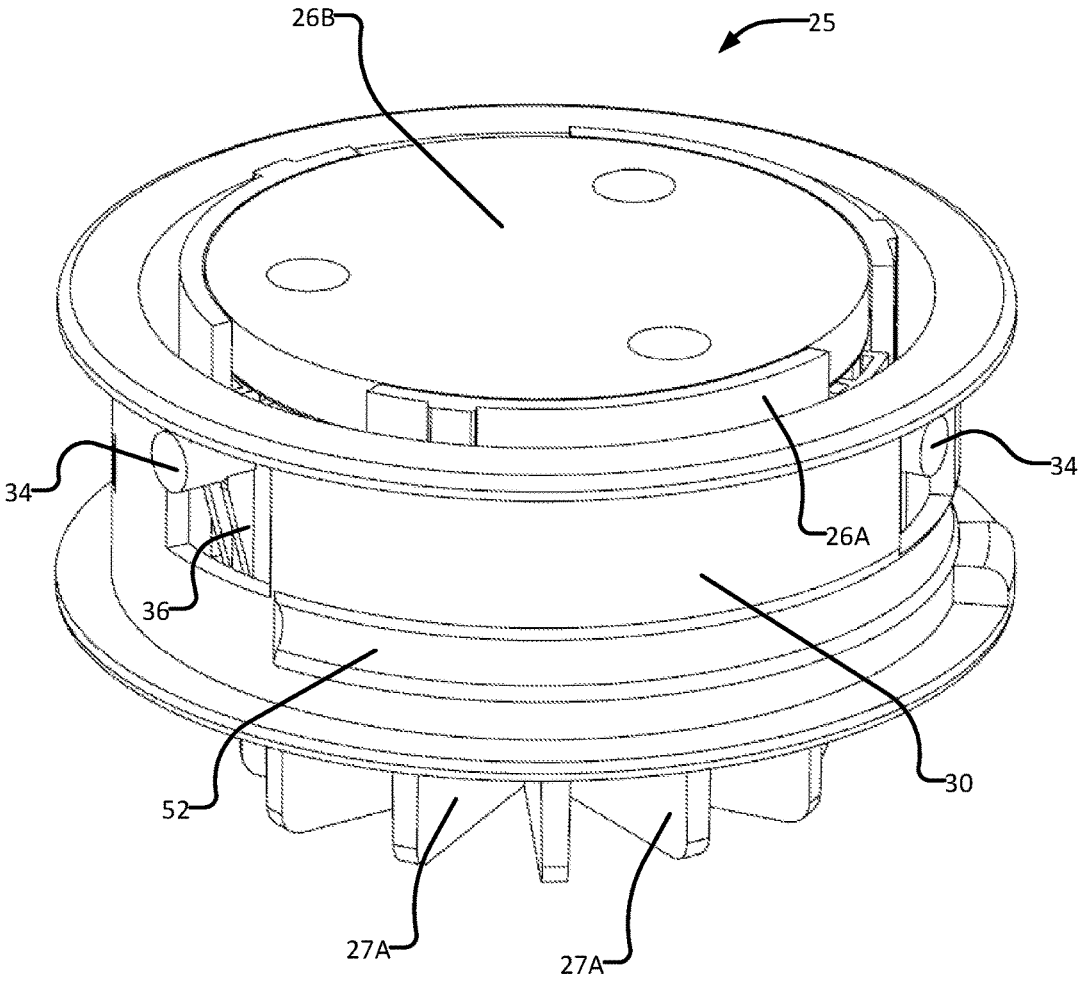
FIG. 4 shows the assembly of FIG. 3 without a cam ring.

FIG. 3 is a close-up perspective view of mechanism 25 including grip ring 30 and piston 26 of dispenser 10 with top cap 14 removed. FIG. 3 shows that piston 26 may be made in two or more parts. In the illustrated embodiment, piston 26 has a lower part 26A and an upper part 26B. Upper and lower parts 26A, 26B define a generally cylindrical body with an internal cavity 26C (shown in FIG. 5). Driven arms 36 are received within cavity 26C. Slots 26D in the walls of piston 26 allow cam followers 34 on driven arms 36 to project outwardly from cavity 26C. Lower part 26A and upper part 26B may be connected together in any suitable manner, including for example via one or more of screws, snap tabs, welds, suitable adhesive, rivets, or the like.

In the illustrated embodiment cam followers 34 of driven arms 36 project though slots 37 in cam ring 32. Cam surfaces 35 are provided by the edges of slots 37 closest to top cap 14. FIG. 3 illustrates an example construction of grip ring 30 and cam ring 32. In this example embodiment, each of slots 37 is provided on a cam ring outer 32A. Cam ring outers 32A may snap together to form cam ring 32.

One of cam ring outers 32A may comprise a post to connect to end 48B of extension spring 48, as described above (see FIG. 7). The same cam ring outer 32A may also comprise a boss feature to stop against boss feature 56 of grip ring 30. The other cam ring outers 32A need not comprise these features.

Cam ring 32 maybe fixed axially with respect to grip ring 30. For example, cam ring 32 and/or grip ring 30 may comprise flanges and/or channels that allow relative rotation of cam ring 32 and grip ring 30 while maintaining axial alignment of cam ring 32 and grip ring 30. FIG. 8 shows a possible construction in which flanges 30A and 30B, which project radially outwardly on grip ring 30, extend into a channel defined between end surfaces 32A and 32B of cam ring 32.

The range of rotation of cam ring 32 relative to cam followers 34 may be limited. In the illustrated embodiment, rotation of cam ring 32 is limited by the engagement of followers 34 with the ends 37A of cam slots 37.

In the illustrated embodiment, cam follower 34 on each driven arm 36 may project radially outwardly past an outer wall of dispenser body 12 such that cam followers 34 project into slots 37 in cam ring 32, as shown in FIG. 3. When mechanism 25 is not being actuated, grip ring 30 is free to float longitudinally relative to body 12 so that if dispenser 10 is being held upright cam surfaces 35 rest by gravity on the corresponding cam followers 34.

In operation, an applied force or torque (for example, a twisting motion by an end user applied to cam ring 32) causes grip ring 30 to be rotated from its start position relative to dispenser body 12. Grip ring 30 may be rotated in a direction (e.g. the actuation direction) opposite to the bias force placed on cam ring 32 by extension spring 48. For example, the biasing force may tend to turn grip ring 30 in a counterclockwise direction, and grip ring 30 may be rotated in a clockwise direction or vice versa.

During a first portion of the rotation of grip ring 30, the tension in extension spring 48 prevents any relative rotational movement between grip ring 30 and cam ring 32. Thus, cam ring 32 and grip ring 30 initially rotate together relative to dispenser body 12. As grip ring 30 is rotated, teeth 46 carried by grip ring 30 each come to engage a respective tooth 21 on a respective toothed rack 20 of dispenser body 12 (see FIG. 10B). In some embodiments, on a given toothed rack 20, a tooth 46 on grip ring 30 may engage a tooth 21 that is relatively farther toward dispenser cap 16 than the tooth 21 which is engaged by the respective tooth 38 of driven arm 36 (see FIG. 10).

When each tooth 46 on grip ring 30 becomes fully engaged with a tooth 21 of the respective toothed rack 20, grip ring 30 is prevented from further rotating in the actuation direction relative to dispenser body 12. Teeth 21 may each have a substantially horizontal surface (see FIGS. 6 and 10), such that grip ring 30 is also constrained from any longitudinal movement toward top cap 14. Cam ring 32 is also constrained from such longitudinal movement, due to its connection to grip ring 30 as discussed above (see, for example, FIG. 8).

Under continued applied torque, cam ring 32 may continue to rotate relative to both dispenser body 12 and grip ring 30. This rotation further extends extension spring 48. During this rotation, cam ring 32 continues to be constrained from moving toward top cap 14. Therefore, the sloped profiles (best seen in FIG. 3) of cam surfaces 35 acting on cam followers 34 cause cam surfaces 35 to drive cam followers 34 toward dispenser cap 16 (see FIG. 10C).

As cam followers 34 move toward dispenser cap 16, teeth 38 on driven arms 36, which to this point have remained engaged with respective teeth 21 on toothed racks 20, are also carried toward dispenser cap 16 (see FIG. 10C). The profile of teeth 21 allow teeth 38 on driven arms 36 to move in a rotational direction opposite to the actuation direction (i.e. to the right side of FIG. 10) and to drop into engagement with the next tooth 21 closer to dispenser cap 16 (see FIG. 10D).

The re-engagement of teeth 38 with teeth 21 is facilitated by compression springs 42, which force driven arms 36 to move back in the actuation direction (to the left as seen in FIG. 10) to their original start position (engaged with the horizontal surface of tooth 21), but now incrementally closer to dispenser cap 16 by one tooth 21. The connection of driven arms 36 to piston 26 causes piston 26 to move incrementally towards dispenser cap 16 along with driven arms 36.

The applied force may continue to cause cam ring 32 to rotate in the actuation direction until cam followers 34 reach end 37A of linear cam surfaces 35. At this point, cam ring 32 is prevented from further rotational movement, and the applied force may be removed. Linear cam surfaces 35 may have lengths which correspond to cam followers 34 reaching ends 37A of linear cam surfaces 35 immediately after driven arms 36 and piston 26 are moved incrementally towards dispenser cap 16. In such embodiments, a tactile or audible "click" of teeth 38 re-engaging with their respective teeth 21 may indicate to a user to stop rotating cam ring 32. In alternative embodiments, cam surfaces 35 may have slightly longer lengths.

When the applied force is removed (e.g. when a user releases grip ring 30), extension spring 48 contracts to pull cam ring 32 in a direction opposite to the actuation direction, back to its start position relative to grip ring 30. The momentum of this movement causes cam ring 32 and grip ring 30 to continue to move together in this direction back to their start position relative to dispenser body 12. Correspondingly, teeth 46 on grip ring 30 are moved out of engagement with teeth 21 on toothed racks 20 (see FIG. 10E). Because cam followers 34 on driven arms 36 are now closer to dispenser cap 16, grip ring 30 can fall by gravity toward dispenser cap 16 until linear cam surfaces 35 come to rest on cam followers 34. Mechanism 25 is thereby returned to its start position, as shown in FIGS. 1 and 10A, except now incrementally closer to dispenser cap 16 by a distance corresponding to the size of one tooth 21. A spring or other bias mechanism may optionally be provided to pull or push grip ring 30 toward dispenser cap 16. Ts spring may, for example comprise a helical spring that extends around body 12 and/or an extension spring located between top cap 14 and piston 26.

As described above, a pouch may be contained within dispenser body 12 containing sauce or another flowable material. The pouch may be large enough such that a lower surface 27 of piston 26 contacts a first end of the pouch when mechanism 25 is in its start position. The configuration of surface 27 may vary depending on the type of pouch used. In the illustrated embodiment, lower surface 27 comprises a plurality of radiating ribs 27A that are spaced apart around the outer periphery of piston 26 (see FIGS. 4 and 5).

The incremental longitudinal movement of piston 26, as described above, may thus compress the pouch in the direction of dispenser cap 16. A second end of the pouch may have one or more holes, nozzles, slits, or other openings and may be engaged with dispenser cap 16 such that this longitudinal force causes a predetermined amount of sauce or other flowable material to be expelled from the pouch and dispensed from dispenser 10 through dispenser cap 16 with each incremental movement.

The amount of material dispensed will depend on the extent of the incremental movement of piston 26, and therefore on the shape of cam surfaces 35, the range of rotational motion of cam ring 32, and the spacing between teeth 21 on toothed racks 20. For example, increasing the pitch of teeth 21 (such that fewer teeth 21 are needed to span the length of toothed racks 20) and providing a cam ring 32 that has steeper cam surfaces 35 may increase the length of incremental movement of piston 26, and thereby cause a larger volume of sauce or other material to be dispensed with each incremental movement. In some embodiments, teeth 21 are sized such that 4 to 30 mL, and in some example embodiments 6 mL (~⅕ fl. oz.), of sauce or other material is dispensed with each incremental movement of piston 26.

With repeated incremental movement of grip ring 30 and piston 26 in the manner described above, mechanism 25 will eventually reach the ends of toothed racks 20 closest to dispenser cap 16. The pouch contained within dispenser body 12 may be substantially emptied at this point.

Once mechanism 25 reaches the end of toothed racks 20, cam ring 32 may be rotated in a direction opposite to the actuation direction. This direction may be called the "return direction". This rotation causes cam surfaces 35 to force driven arms 36 in the return direction via cam followers 34, and eventually disengages teeth 38 of driven arms 36 from teeth 21 of toothed racks 20.

Figure 11:
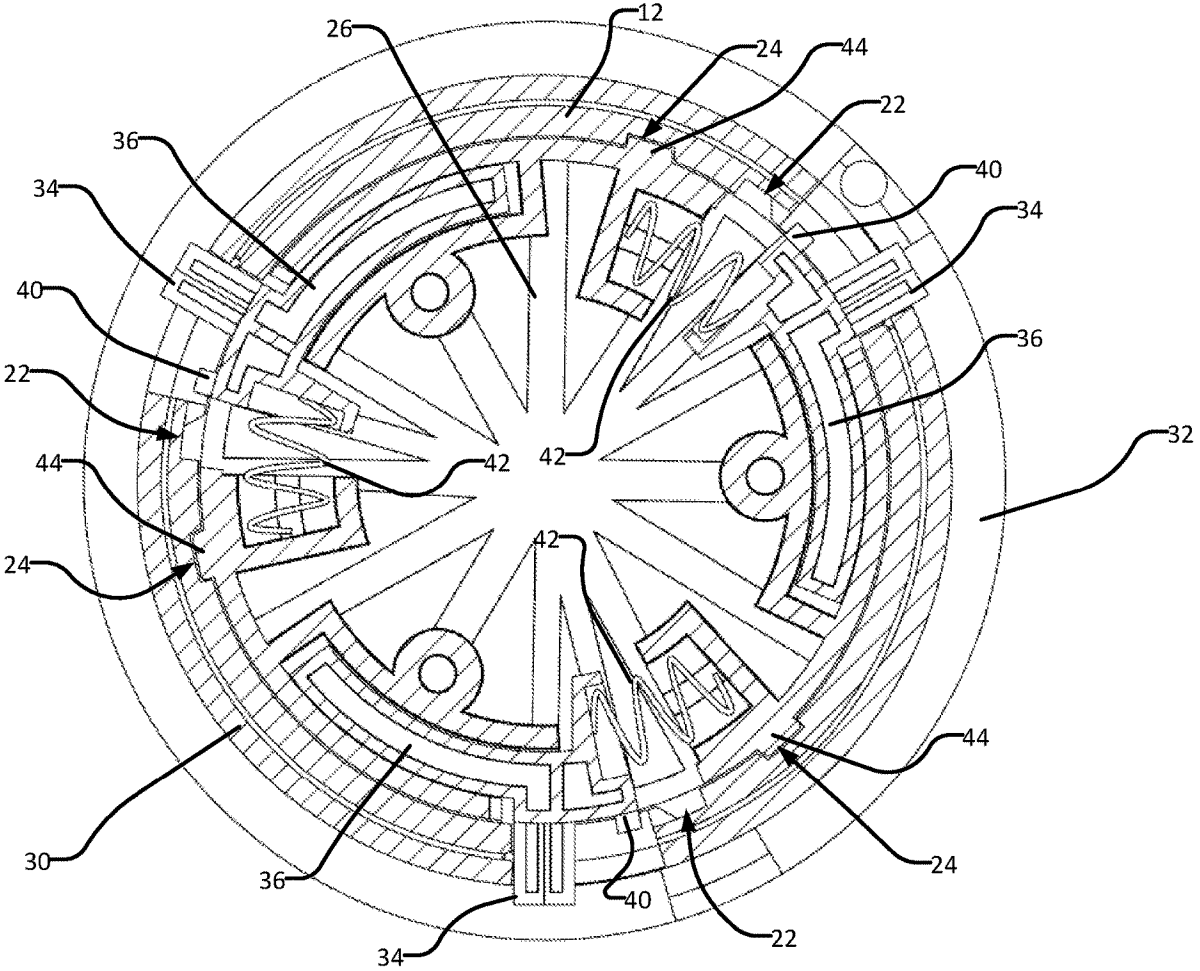
FIG. 11 is a cross sectional top view of the FIG. 3 grip ring and piston mechanism.
Figure 12:
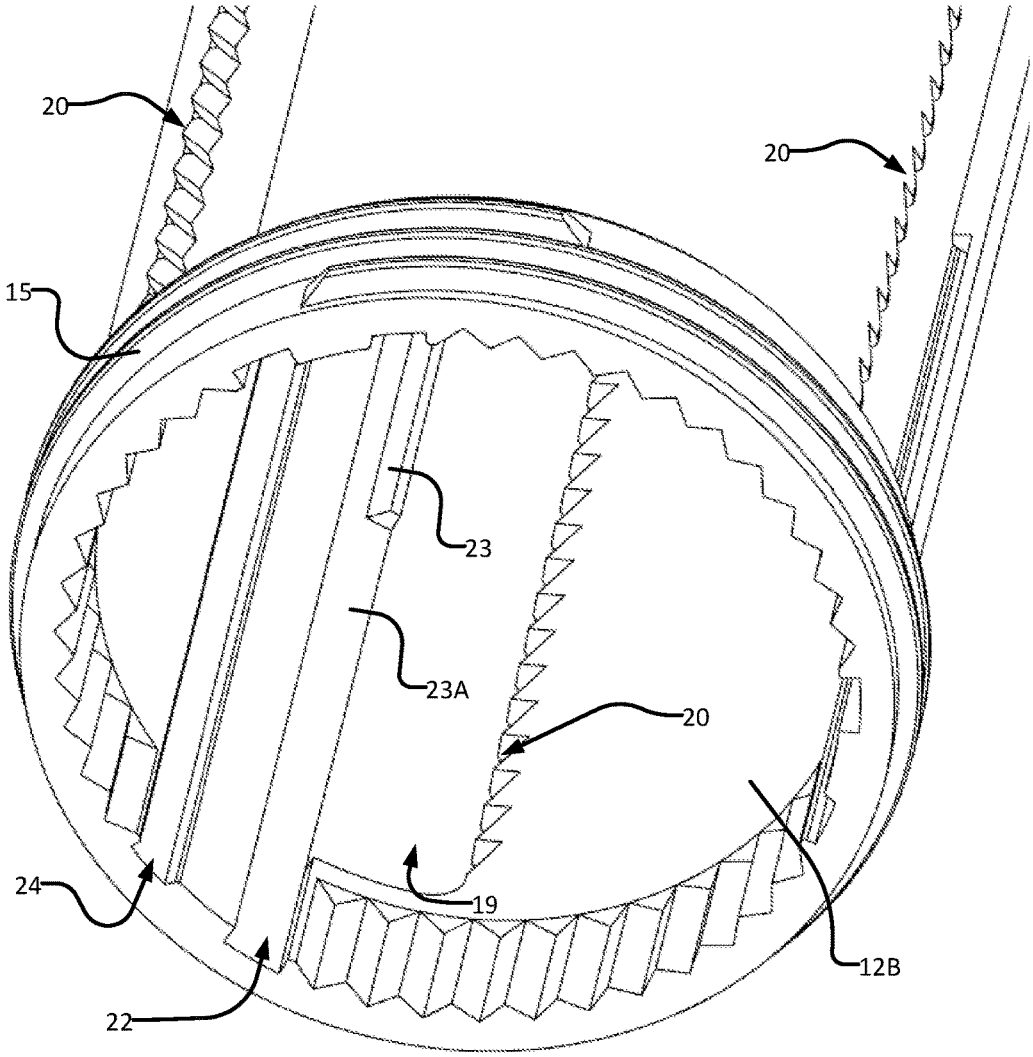
FIG. 12 is a perspective view of an end of the FIG. 1 twist dispenser, without a dispenser cap.
Figure 13:
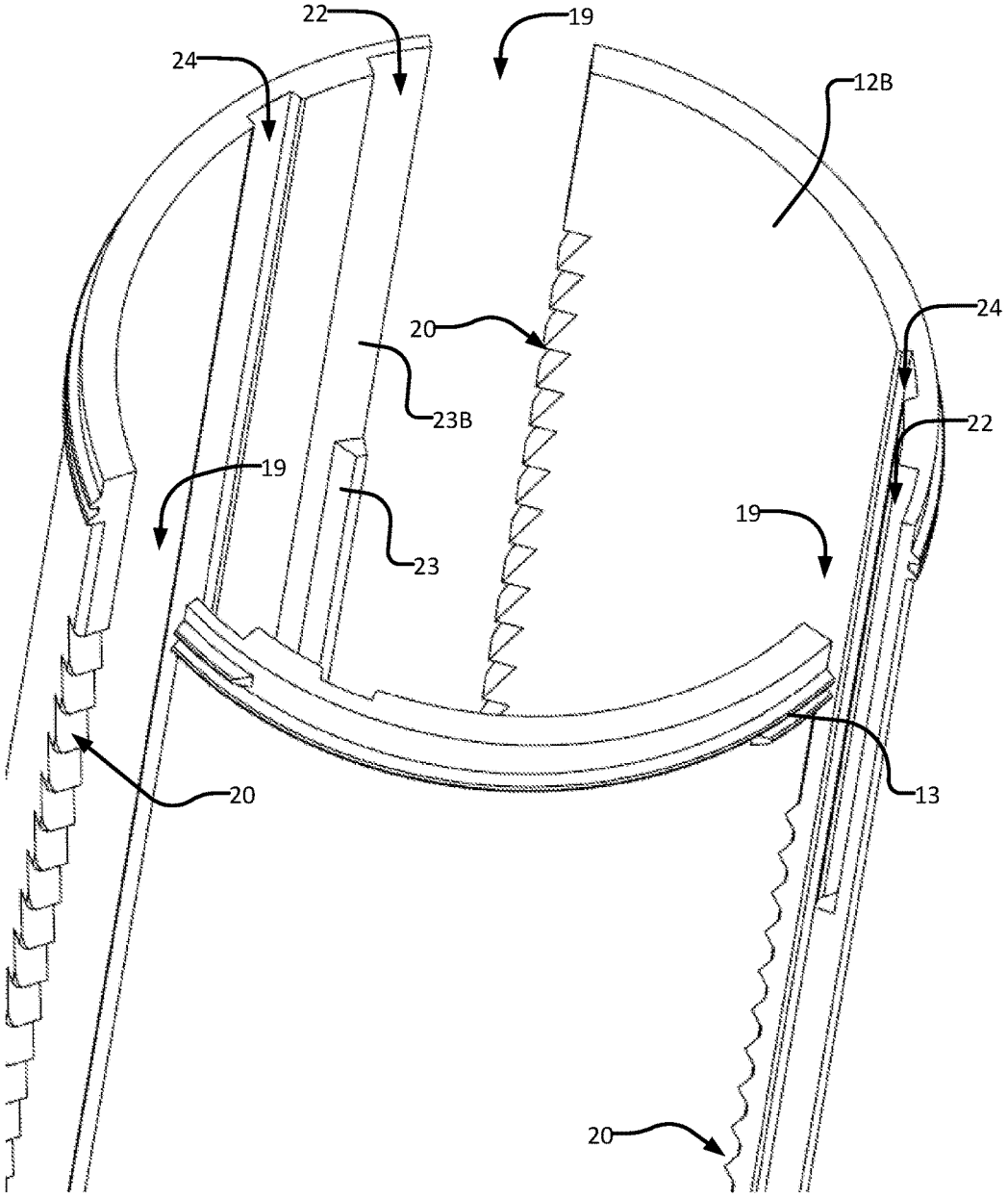
FIG. 13 is a perspective view of the opposing end of the FIG. 1 twist dispenser, without a top cap.

FIG. 11 shows longitudinal tongues 40 and piston return tracks 22 disengaged from one another. It can be appreciated that movement in the return direction of driven arms 36 would cause longitudinal tongues 40 to enter piston return tracks 22. FIG. 12 shows wall 23 of piston return track 22, and the break 23A in wall 23 near the end of dispenser body 12 closest to dispenser cap 16.

Cam ring 32 is rotated in the return direction until longitudinal tongues 40 of driven arms 36 are fully contained within their respective piston return tracks 22. At this point, grip ring 30 and cam ring 32 can be slid together toward top cap 14. During this movement, longitudinal tongues 40 on driven arms 36 are contained within piston return tracks 22 by walls 23. This prevents teeth 38 on driven arms 36 from engaging toothed racks 20 (which they would otherwise tend to do, due to the biasing force provided by springs 42). This allows for unimpeded return movement of mechanism 25 along piston return tracks 22 toward top cap 14.

At the point where mechanism 25 is at or near its start position on dispenser body 12 (as shown in FIG. 1), there is another break 23B (see FIG. 13) in wall 23 of each piston return track 22. Break 23B allows longitudinal tongues 40 on driven arms 36 to leave piston return tracks 22, due to the biasing force provided by compression springs 42. This force pushes driven arms 36 in the actuation direction until teeth 38 are once again engaged with respective teeth 21 on toothed racks 20 (see e.g. FIGS. 6 and 10A). Mechanism 25 is thus returned to its start position as shown in FIG. 1, at the end of toothed racks 20 closest to top cap 14.

Once mechanism 25 has been returned to its start position, dispenser cap 16 may be removed. The empty pouch contained within dispenser body 12 may then be removed and replaced with a full pouch. Dispenser cap 16 may then be reattached to dispenser body 12. Dispenser 10 is then ready for re-use in the manner described above. In some alternative embodiments, dispenser cap 16 may be removed and the empty pouch removed while mechanism is still at an end of dispenser 10 closest to dispenser cap 16, before it has been returned to its start position. Mechanism 25 may then be returned to its start position in order to insert a full sauce pouch and re-attach dispenser cap 16.

Figure 14:
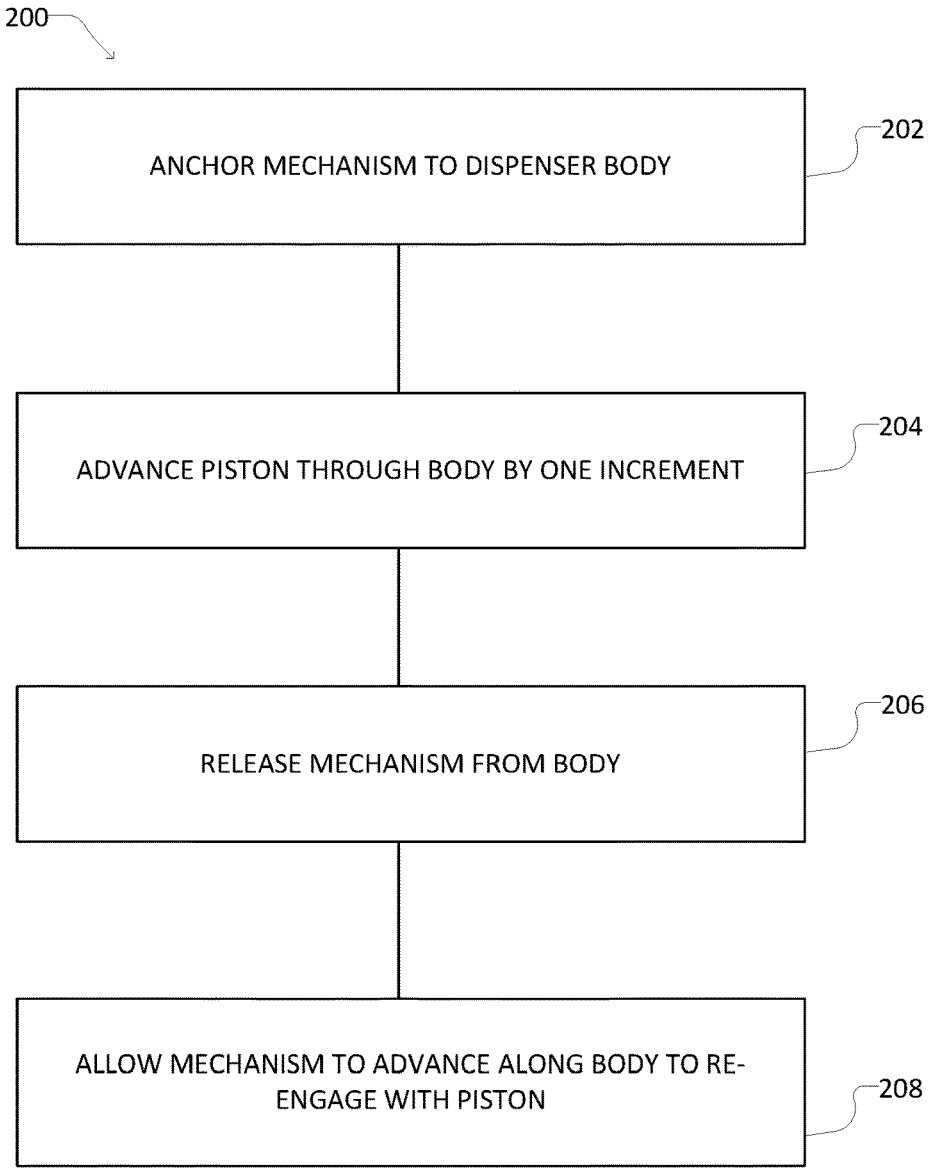
FIG. 14 is a block diagram illustrating a method for dispensing flowable material from a twist dispenser of the general type illustrated by FIG. 1.

FIG. 14 is a block diagram of the method described above used to dispense sauce or other material from a twist-action, portion-control dispenser. Method 200 begins at block 202, where a mechanism (e.g. grip ring 30) is anchored to dispenser body 12 (e.g. by rotating cam ring 32 until teeth 46 on grip ring 30 engage with teeth 21 on dispenser body 12).

In block 204, piston 26 is advanced through dispenser body 12 by one increment (e.g. by one tooth 21). In the embodiment illustrated above, this is achieved by continuing to rotate cam ring 32 until cam surfaces 35 force driven arms 36 and piston 26 to move one tooth 21 closer to dispenser cap 16.

In block 206, the mechanism (e.g. grip ring 30) is released from dispenser body 12. In the embodiment illustrated above, this occurs when cam ring 32 is released, such that extension spring 48 pulls cam ring 32 back to its start position relative to grip ring 30. The momentum of this movement then causes continued rotational movement of grip ring 30 until teeth 46 are disengaged from teeth 21, and grip ring 30 is free to move longitudinally along dispenser body 12.

In block 208, the mechanism (e.g. grip ring 30) is allowed to advance along dispenser body 12 until it re-engages with piston 26. In the illustrated embodiment, grip ring 30 falls by gravity until cam surfaces 35 come to rest on cam followers 34 on driven arms 36.

Figure 15:
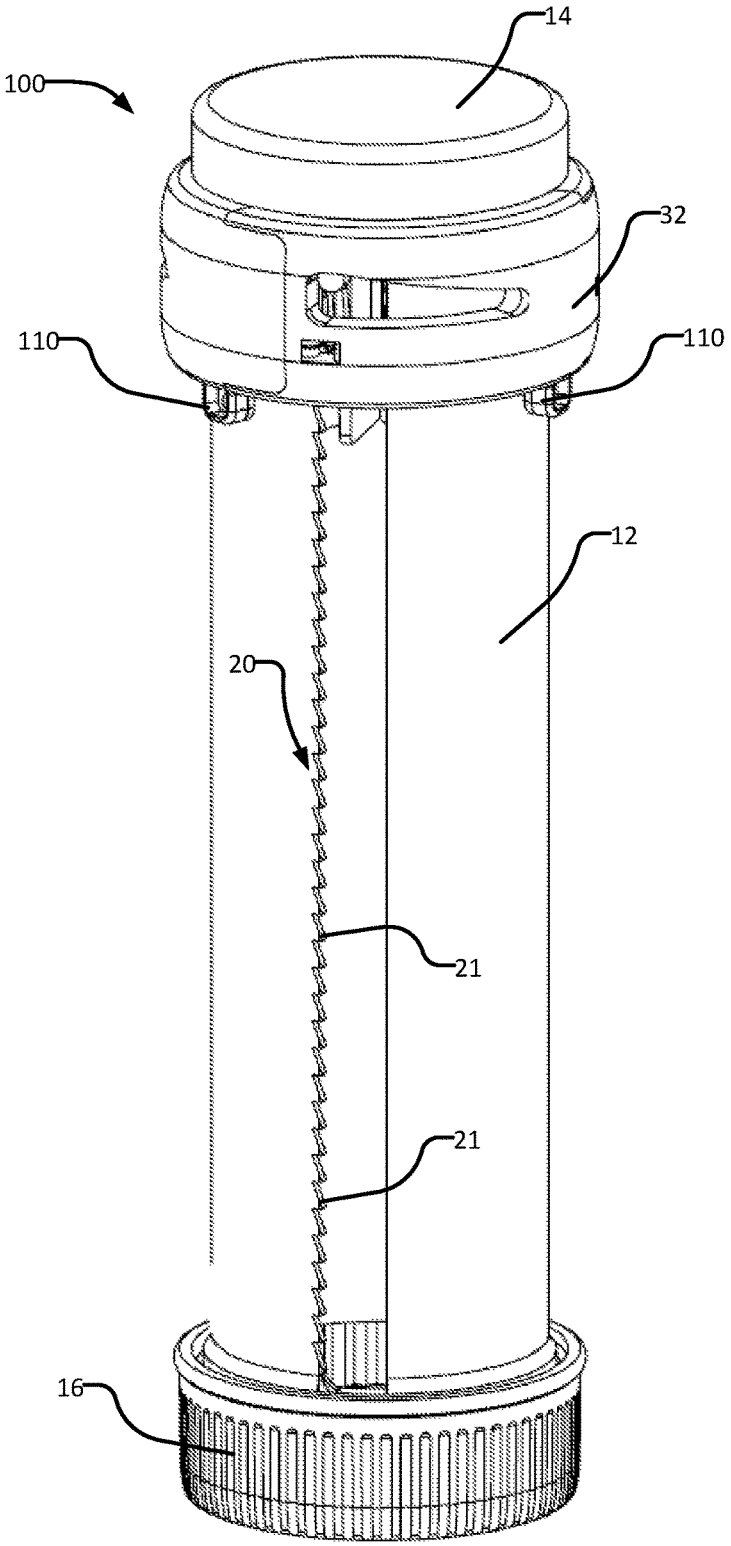
FIG. 15 is a front perspective view of a twist dispenser according to another embodiment of the invention.

FIG. 15 shows a twist-action, portion-control dispenser 100, according to another embodiment of the invention. Components of dispenser 100 which are the same or similar to those of dispenser 10 are labeled with the same references. Dispenser 100 differs from dispenser 10 in that cam ring 32 supports one or more bearings 110. Bearings 110 may be circumferentially spaced around cam ring 32.

Bearings 110 facilitate grip ring 30 and cam ring 32 being able to slide freely toward dispenser cap 16 after piston 26 and driven arms 36 have been incrementally advanced towards dispenser cap 16. Bearings 110 maintain a gap 116 (see FIG. 17) between cam ring 32 and dispenser body 12. Bearings 110 may be particularly advantageous in cases where the walls of body 12 are made thin for reduced weight, material cost, and/or overall dimensions of dispenser 100 such that pressures exerted on the interior of body 12 during operation may cause body 12 to bulge outwardly somewhat.

Figure 16:
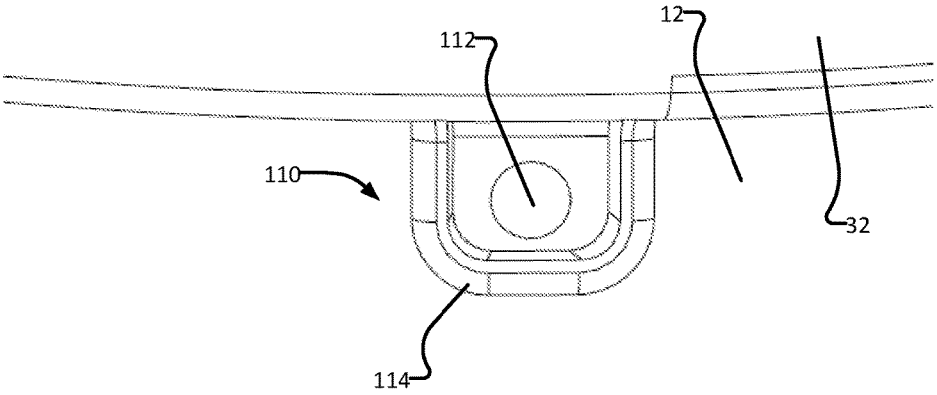
FIG. 16 is a perspective front view of a ball bearing on the FIG. 15 twist dispenser.
Figure 17:
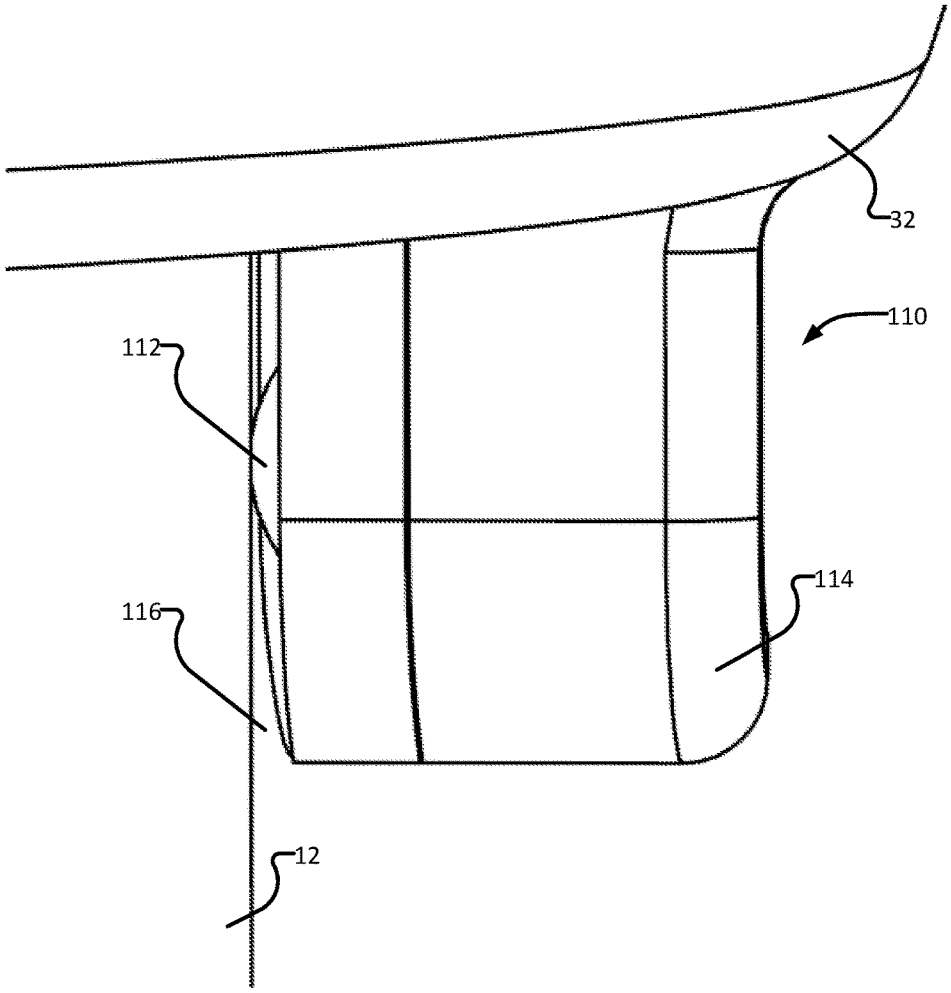
FIG. 17 is a perspective side view of the FIG. 16 ball bearing.

Bearings 110 may project radially inward from cam ring 32 such that gap 116 is maintained between cam ring 32 and the walls of dispenser body 12. FIGS. 16 and 17 are views showing an example arrangement of bearings 110. In the illustrated embodiment, each bearing 110 includes a ball 112 contained within a housing 114 which is connected to cam ring 32. Other embodiments may provide, for example, a horizontally-oriented cylindrical roller to serve the same function as ball 112.

Housing 114 may act as a material spring to keep ball 112 in contact with dispenser body 12, even as the walls of dispenser body 12 move radially as dispenser 100 is used. In other embodiments, another spring (such as a metal spring, a helical spring, a torsion spring, or a leaf spring) may be provided to urge ball 112 into contact with dispenser body 12.

Figure 18:
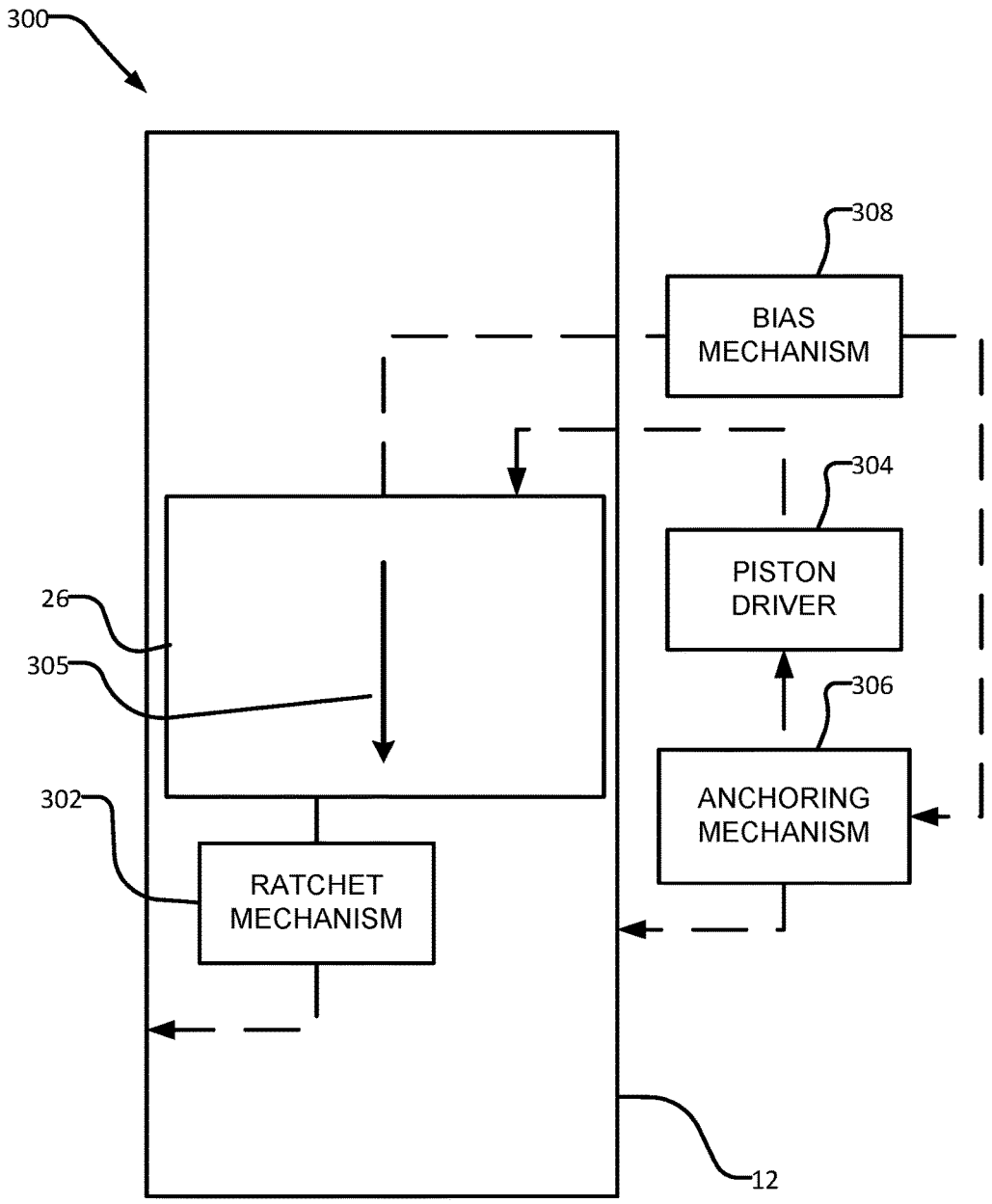
FIG. 18 is a schematic illustration showing a dispenser according to another example embodiment.

FIG. 18 is a schematic illustration showing major functional components of a dispenser 300 according to an example embodiment. Dispenser 300 includes a piston 26 that is longitudinally movable within a body 12. A ratchet mechanism 302 acting between piston 26 and body 12 allows piston 26 to move in a forward direction 305 but holds piston 26 against moving along body 12 in a direction opposite to forward direction 305.

Piston 26 can be advanced along body 12 to dispense a product by a piston driver 304 that can be selectively anchored to body 12 by an anchoring mechanism 306. Ratchet mechanism 302, anchoring mechanism 306 and piston driver 304 may, for example, be provided by structures that are the same as or similar to the structures that provide corresponding functions in any or the other embodiments described herein.

A bias mechanism 308 acts between piston 26 and anchoring mechanism 306. Bias mechanism 308 urges anchoring mechanism in forward direction 305 relative to piston 26.

Operation of dispenser 300 may start with piston 26 located at some initial position along body 12. Piston 26 is held against moving opposite to direction 305 by ratchet mechanism 302. Anchoring mechanism 306 is then operated to selectively engage body 12, thereby providing a base against which piston driver 304 may act. Piston driver 304 is then operated to push piston 26 in direction 305 along body 12. Ratchet mechanism 302 allows motion of piston 26 in direction 305. Anchoring mechanism 306 is then released. This allows bias mechanism 308 to advance anchoring mechanism 306 along body 12. This sequence of operations results in piston 26 advancing along body 12 by one increment. This sequence may be repeated as many times as necessary to advance piston 26 along body 12 until substantially all material has been dispensed from dispenser 300. At this point, ratchet mechanism may be released to allow piston 26 to be returned to a starting position so that dispenser 300 may be refilled.

In some embodiments, a user can operate dispenser 300 by moving a single operating member such as a twist ring or knob. For example, rotation of a cam ring may cause a grip ring to engage a feature of body 12. Continued rotation of the cam ring may apply force between the grip ring and piston to advance the piston. The continued rotation of the grip ring may also supply energy to the bias mechanism (e.g. by compressing a spring). Counter-rotating the grip ring may disengage the grip ring from the body feature and allow the bias mechanism to advance the grip ring and cam ring along the body.

FIGS. 18A through 18F show a dispenser 400 according to another example embodiment of the invention. Dispenser 400 may operate like dispenser 300. Dispenser 400 includes a twist-action actuation mechanism which may operate in a similar manner to the actuation mechanisms of dispensers 10 and 100 and 300 which are described elsewhere herein. Like dispenser 300, dispenser 400 includes a bias mechanism that advances the operating mechanism of dispenser 400 as dispenser 400 is operated to dispense material.

Components of dispenser 400 which may be similar to or common to components of dispensers 10 and 100 are labelled with the same reference numbers as are used to identify the corresponding components of dispensers 10 and 100.

Dispenser 400 includes a bias mechanism 410 that serves to advance grip ring 30 and cam ring 32 along body 12 after each portion has been dispensed. In some embodiments bias mechanism 410 takes in and stores energy when piston 26 is advanced relative to grip ring 30 and then releases the energy to advance grip ring 30 and cam ring 32 when grip ring 30 becomes disengaged from body 12.

Figure 18A:
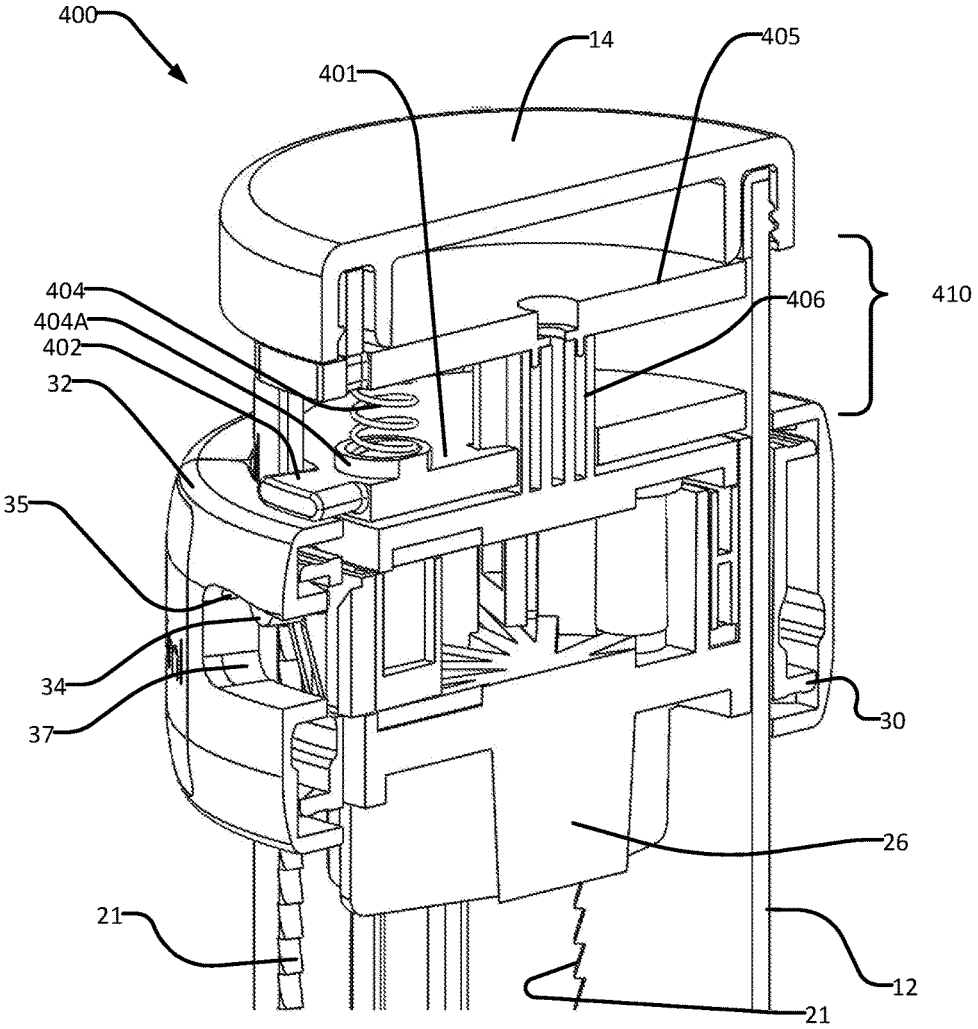
FIGS. 18A to 18F are cross-sectional views through a dispenser according to another example embodiment of the invention, the views illustrate a sequence of configurations as the dispenser is operated.
Figure 18B:
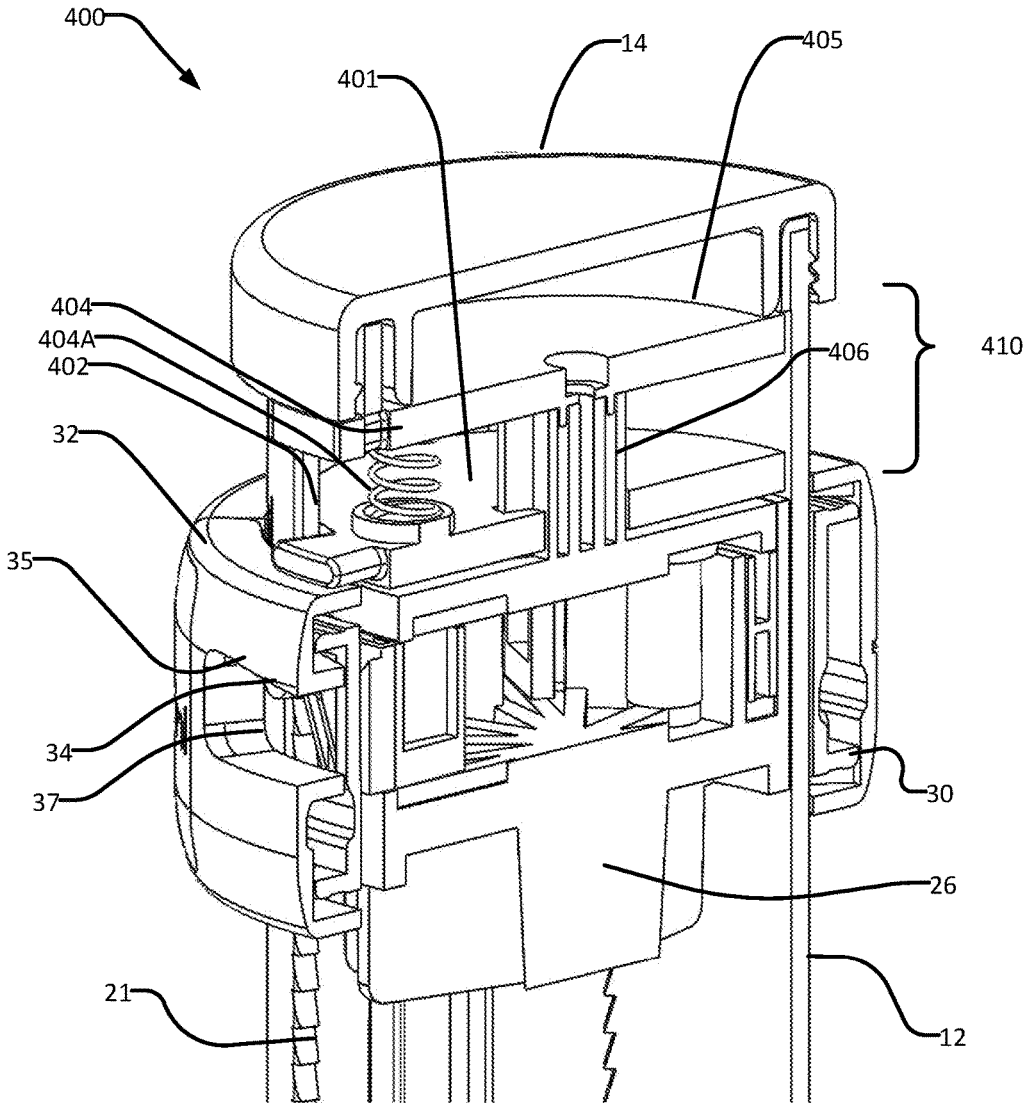
Figure 18C:
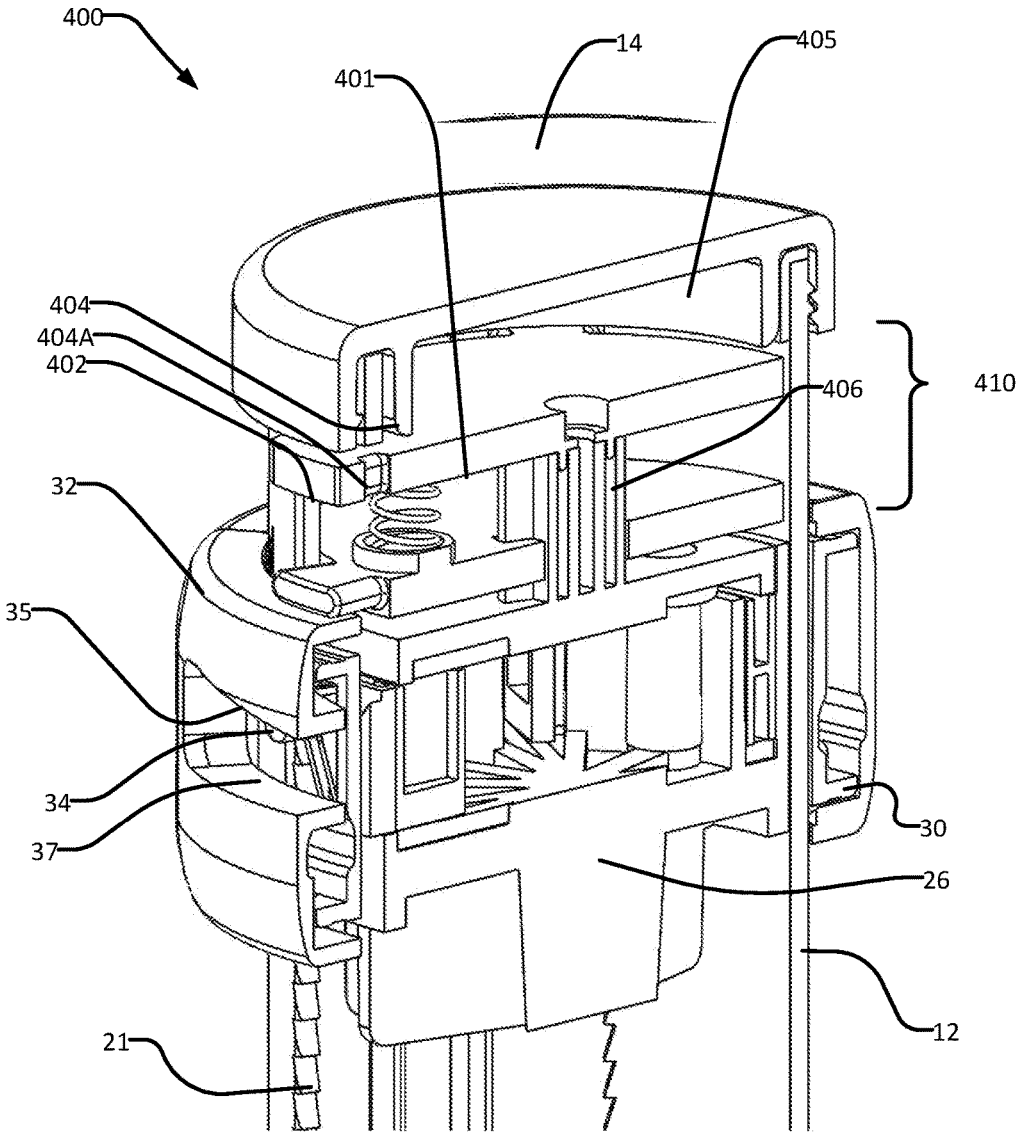
Figure 18D:
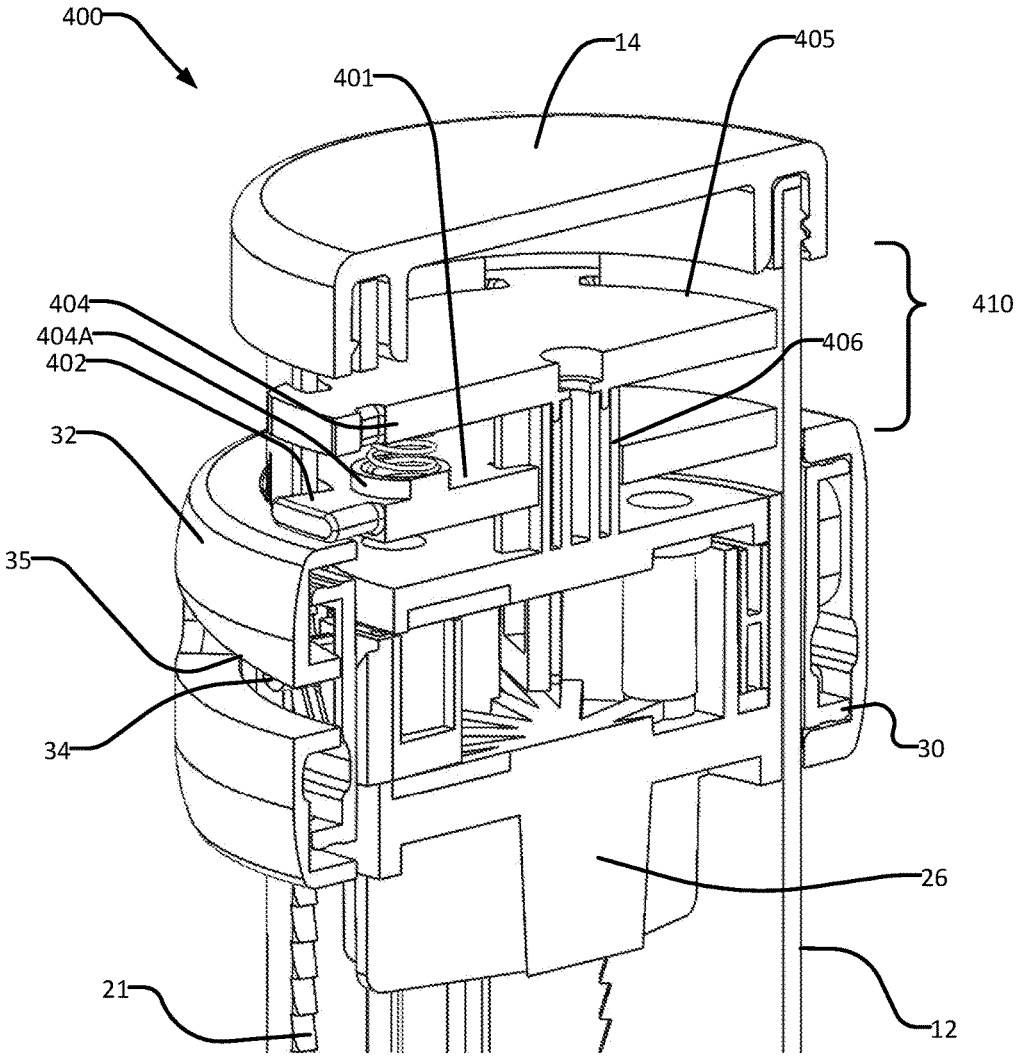
Figure 18E:
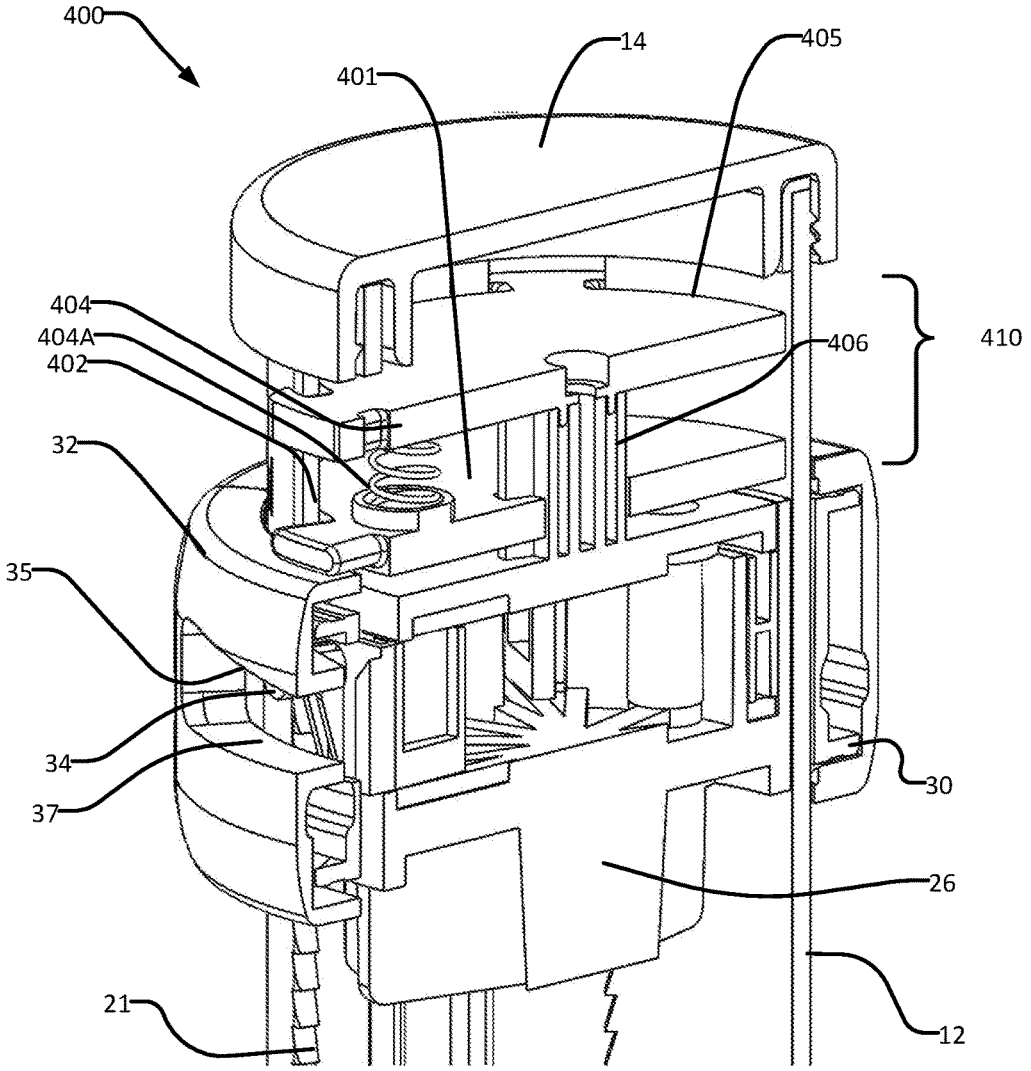
Figure 18F:
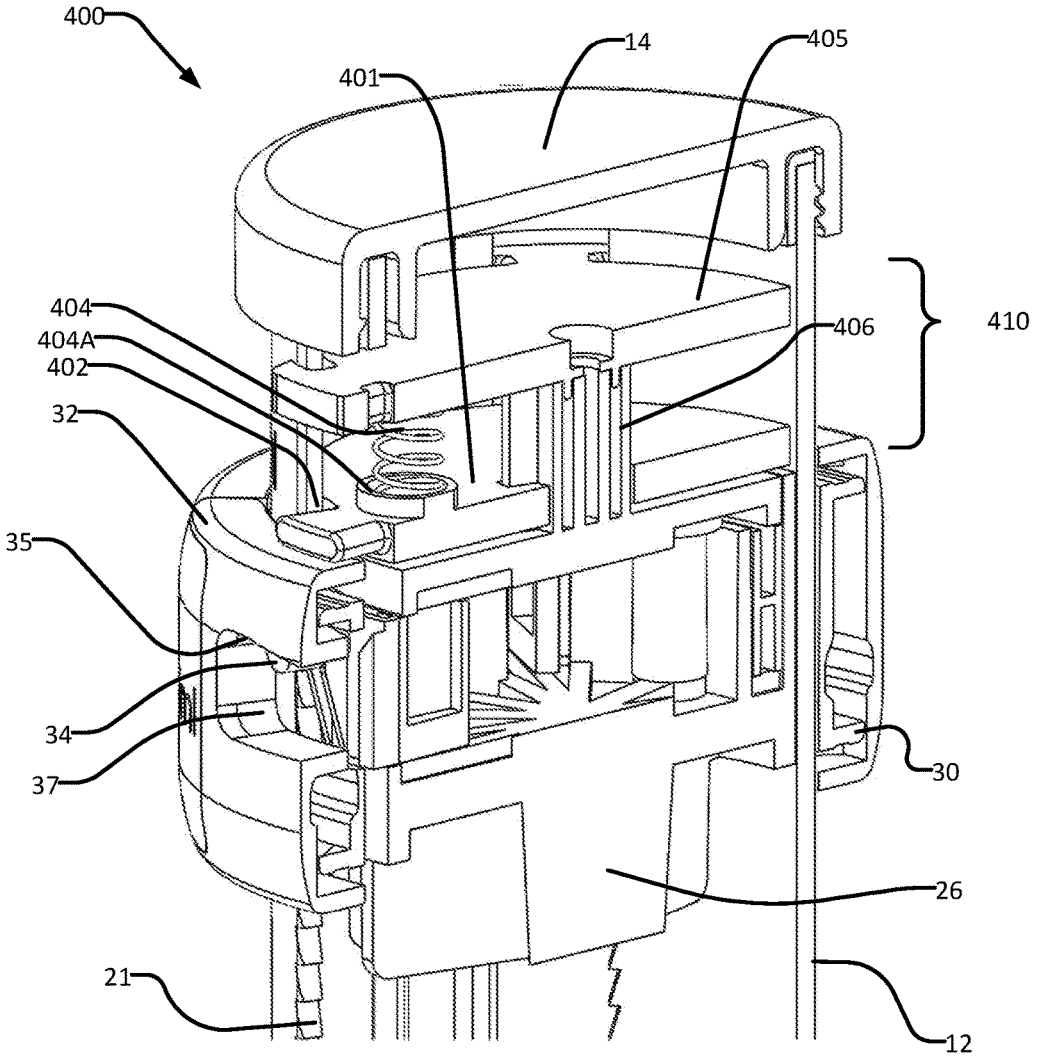

FIGS. 18A to 18F illustrate the configuration of an example dispenser 400 at various stages in the operation of dispenser 300. FIG. 18A shows dispenser 300 in an initial state. FIG. 18B shows dispenser 400 with grip ring 30 rotated from its initial state so that teeth are engaged. FIG. 18C shows dispenser 400 with grip ring 32 further rotated so that cam surfaces 35 have acted to push piston 26 down by ½ increment. FIG. 18D shows dispenser 400 with grip ring 32 further rotated so that piston 26 has been advanced one full increment. In FIG. 18E grip ring 32 has been released. A bias mechanism 410 has advanced grip ring 32 along body 12 by ½ increment. In FIG. 18F bias mechanism 410 has advanced grip ring 32 by one full increment to a new initial state.

In the illustrated embodiment, bias mechanism 410 includes a spring plate 401 that has fingers 402 that bear on cam ring 32. Spring plate 401 is urged in a forward direction relative to piston 26 (i.e. toward a dispensing end of dispenser 400). Fingers 402 act on cam ring 32 and urge cam ring 32 to move in the forward direction. One or more springs 404 or other resiliently expanding structures act between spring plate 401 and a backing plate 405. Backing plate 405 is coupled to and moves longitudinally with piston 26. In the illustrated embodiment backing plate 405 is attached to piston 26 by rod 406.

As shown in FIG. 10A, in the illustrated embodiment ends of plural springs 404 are kept located by features 404A on spring plate 401 and/or on backing plate 405. Features 404A may comprise, for example, rings, pegs, projections or the like that engage ends of spring 404.

Dispenser 400 may use the same mechanism to incrementally advance piston 26 as provided in any of the other embodiments described herein. For example rotation of cam ring 32 may operate to anchor cam ring 32 longitudinally to body 12 by rotating grip ring 30 such that features on grip ring 30 engage corresponding features (e.g. teeth 21) on body 12. Further rotation of cam ring 32 may cause cam surfaces 35 to advance piston 26 by moving cam followers 34.

As can be seen by comparing FIGS. 18B and 18D, as piston 26 is advanced longitudinally relative to body 12 while cam ring 32 and grip ring 30 remain at the same longitudinal position along body 12 the clearance between backing plate 405 and spring plate 401 is reduced. This compresses springs 404.

As can be seen by comparing FIGS. 18D and 18F, when cam ring 32 is released (thereby allowing grip ring 30 to move longitudinally relative to body 12) the force exerted by spring(s) 404 (or other bias mechanism) between back plate 405 and spring plate 401 pushes cam ring 32 and grip ring 30 in forward direction 405 along body 12. Since back plate 405 is connected to piston 26, back plate 405 is prevented from moving in a rearward direction by a ratchet mechanism (a non-limiting example of a ratchet mechanism is shown in FIG. 5).

A dispenser 300 or 400 may optionally include any feature of any other embodiment described herein.

The components described herein may be made of any suitable material or materials, including but not limited to: polypropylene (PP) plastic, polycarbonate (PC) plastic, polyoxymethylene (POM) plastic, acrylonitrile butadiene styrene (ABS) plastic, or other types of injection-molded plastics; a metal injection-molded (MIM) material; metal; or combinations of any of the above.

As will be apparent to those skilled in the art in light of the foregoing disclosure, many alterations and modifications are possible in the practice of this invention without departing from the spirit or scope thereof. Possible alterations and modifications include, without limitation:

In the illustrated embodiment, body 12 of dispenser 10 has three longitudinal slots 19. Other numbers of slots 19 may be provided by alternative embodiments. Some embodiments have two to five slots. Some embodiments have one slot.

While the embodiments described above include three each of toothed racks 20, piston return tracks 22, guide tracks 24, cam ring outers 32A, driven arms 36, compression springs 42, longitudinal tongues 40, longitudinal tongues 44, and teeth 46, this is not necessary. In other embodiments, there may be one, two, four, or some other number of each of these components.

In the above embodiments, top cap 14 is removably attachable to dispenser body 12 via a screwed connection. However, in some embodiments, top cap 14 may not be removable. Top cap 14 may be glued, bonded, sonically welded to, or formed integrally with dispenser body 12. In some embodiments, top cap 14 may also have a top bushing, which may nest into dispenser body 12 and support the inner surface 12B of dispenser body 12. Top cap 14 and the top bushing, if provided, may be separate components, or may be provided in a single component.

Grip ring 30 may include more than one spring 48 for biasing cam ring 32 toward the start rotational position relative to grip ring 30.

In some embodiments, mechanism 25 may have one or more additional springs or other bias mechanisms to supply a force which is opposite to and less than the bias force provided by extension spring 48 in grip ring 30. In such embodiments the bias force provided by the additional springs can provide some or all of the force necessary to disengage teeth 46 from teeth 21 and to return grip ring 30 to its start position. Such additional springs may comprise metal helical springs, torsion springs, material springs, elastic members, or leaf springs, for example.

While compression springs 42 and extension spring 48 are shown in the accompanying Figures as metal helical springs, other embodiments may provide these springs as torsion springs, material springs, or leaf springs, for example. These springs may be made of any suitable material, including metal, plastic, elastomer, or rubber.

The ratchet mechanism may have alternative constructions such as one or more rotatable pinions with one-way ratchets that engage a gear rack formed along body 12 or one or more pawls that engage teeth or recesses on body 12. A control such as a button or lever may be provided to disengage the ratchet mechanism to permit piston 26 to be moved back toward top cap 14.

Racks 20 may be formed on ridges extending along body 12 beside slots 19 instead of being formed along edges of slots 19.

The anchoring and piston-driver parts of mechanism 25 do not need to use the same rack. Separate racks or other engagement features could be provided for these functions.

The exterior surface of dispenser body 12 may include some grooves or other features which may act as grips to aid in the use of dispenser 10 and/or to improve the aesthetic appearance of dispenser 10.

As teeth 38 of driven arms 36 disengage with one tooth 21 on their respective toothed racks 20 and move to the next tooth 21, teeth 38 may move a longitudinal distance that is slightly more than is strictly necessary to engage with the next tooth 21. That is, teeth 38 may move longitudinally to a position that is closer to dispenser cap 16 than the horizontal surface of the next tooth 21, before moving back towards top cap 14 to engage the horizontal surface as compression springs 42 push on driven arms 36. This extra longitudinal movement aids in compressing the pouch contained in dispenser body 12 when mechanism 25 is relatively closer to dispenser cap 16, when there may be extra pressure being exerted on piston 26 by the pouch. This movement may also allow for excess pressure on the pouch to be relieved when dispenser 10 is not in use, thereby preventing material from being dispensed at undesired times.

A dispenser cap may be integrated with a pouch. Dispensing features may be provided by a pouch, a dispenser cap or both a pouch and a dispenser cap.

Longitudinal slots 19 may be relatively wider or narrower as compared to what is shown in the accompanying Figures. Longitudinal slots 19 need only be wide enough to allow teeth 46 on grip ring 30 to disengage with teeth 21 on toothed racks 20, and to allow longitudinal tongues 40 on driven arms 36 to be located outside of piston return tracks 22 while mechanism 25 is incrementally actuated towards dispenser cap 16, and to enter piston return tracks 22 when mechanism 25 is to be moved back to its starting position.

Piston 26 may be provided as single component. Alternatively, upper part 26B of piston 26 need not be provided at all. Piston 26 and driven arms 36 may also be provided in a single component or as separate components.

While toothed rack 20 serves to engage both teeth 38 on driven arms 36 and teeth 46 on grip ring 30, this need not be the case. Separate toothed racks 20, contained in separate longitudinal tracks 19, may be provided for teeth 38 and teeth 46. In such an embodiment, the function of these components as described above would not necessarily change, but teeth 38 and teeth 46 may be circumferentially spaced relative to one another around dispenser body 12.

The accompanying Figures show teeth 21 on toothed racks 20 having a triangular, or "sawtooth", profile. However, other profiles are possible which may serve to constrain upwards relative movement of grip ring 30 and driven arms 36. For example, teeth 21 may have profiles with one or more curved surfaces.

While the above embodiments have been described with reference to the example application of dispensing sauces, the invention is not limited to such uses. For example, other embodiments of the invention may provide a portion-control dispenser for other flowable materials such as icing. Other embodiments may be configured to dispense predetermined portions of a flowable granular material, such as salt or sugar. Dispensers as described herein may also have non-culinary applications such as dispensing adhesives, caulking, or paint.

In FIG. 15, bearings 110 are provided on an edge of cam ring 32 which is relatively closer to dispenser cap 16. This need not be the case, and bearings 110 may be provided on the opposing edge of cam ring 32 (i.e. on the edge which is relatively closer to top cap 14). In other embodiments, one or more bearings 110 may be provided on both edges of cam ring 32.

Bearings 110 need not remain in constant contact with dispenser body 12. In other embodiments, bearings 110 only contact dispenser body 12 when grip ring 30 has returned to its home rotational position relative to dispenser body 12, in order to ensure that grip ring 30 and cam ring 32 are allowed to fall freely towards dispenser cap 16. In such embodiments, dispenser body 12 may be ramped or tapered such that bearings 110 are not in constant contact with dispenser body 12. For example, a wall of dispenser body 12 may be thickest near toothed rack 20 of one slot 19, and may gradually taper to become narrower near an adjacent slot 19. Bearings 110 may only contact dispenser body 12 at their thickest sections.

Dispenser 100 may be modified in the presence of bearings 110 to ensure that the pouch contained within dispenser body 12 is substantially emptied when mechanism 25 reaches the end of toothed racks 20 nearest to dispenser cap 16. For example, in embodiments where bearings 110 are provided on an edge of cam ring 32 relatively closer to dispenser cap 16, piston 26 may be correspondingly taller to accommodate for the extra space that would otherwise be present between piston 26 and dispenser cap 16 when mechanism 25 is at the end of toothed racks 20. This ensures that the pouch will still be substantially empty as mechanism 25 reaches the end of toothed racks 20.

In a dispenser that includes a bias mechanism (such as dispenser 300 or 400) the bias mechanism may comprise one or more coil springs, an air or gas spring, an elastically deformable diaphragm, one or more cantilever springs or the like. The springs may push a spring plate or other member in a forward direction by acting on a backing plate or other member coupled to the piston or may pull the spring plate or other member in the forward direction. In some embodiments, fingers of a spring plate are resiliently deformable to apply a biasing force to an anchoring part.

Interpretation Of Terms

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to";

"connected", "coupled", or any variant thereof, means any connection or coupling, either direct or indirect, between two or more elements; the coupling or connection between the elements can be physical, logical, or a combination thereof;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any claims, depend on the specific orientation of the apparatus described and illustrated. The subject matter described herein may assume various alternative orientations. Accordingly, these directional terms are not strictly defined and should not be interpreted narrowly.

Where a component (e.g. a cam surface, arm, tooth, spring, piston, nozzle, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A dispenser useful for dispensing portions of a flowable material, the dispenser comprising:

a tubular body formed with at least one slot extending longitudinally along the body;

a piston disposed inside the body and movable along the body in a first direction toward a dispensing end of the body;

a ratchet operatively associated between the piston and the body, the ratchet mechanism preventing movement of the piston in a second direction opposite to the first direction; and a piston-actuation mechanism coupled to apply a force sufficient to advance the piston in the first direction by way of the at least one slot, the piston-actuation mechanism comprising an anchoring part and a piston driving part coupled to the anchoring part, the anchoring part comprising a locking member movable between a released position wherein the anchoring part is movable along the body and an engaged position wherein an engagement feature of the locking member mechanically engages a corresponding feature of the body to restrict motion of the anchoring part in the second direction, the piston driving part acting between the anchoring part and the piston by way of the slot and comprising a member movable relative to the anchoring part between a first position and a second position wherein movement of the member from the first position to the second position when the locking member is in the engaged position incrementally advances the piston along the body in the first direction; and a bias mechanism coupled between the anchoring part and the piston, the bias mechanism comprising a deformable member that applies a force to the anchoring part directed in the first direction in response to displacement of the piston in the first direction relative to the anchoring part.

2. A dispenser according to claim 1 wherein the locking member comprises a grip ring extending circumferentially around the body and the piston driving part comprises a cam ring rotatable relative to the grip ring, the cam ring comprising a cam surface arranged to displace the piston on rotation of the cam ring.

3. A dispenser according to claim 2 wherein the deformable member comprises one or more compression springs located between a first member coupled to the piston and a second member engaging the anchoring part.

4. A dispenser according to claim 3 wherein the slot is one of a plurality of longitudinally-extending slots in the wall of the body, the first member comprises a backing plate rigidly coupled to the piston and the second member comprises a spring plate having fingers that project through the slots in the wall of the body to engage the anchoring part.

5. A dispenser according to claim 4 wherein the cam surface is arranged to engage a cam follower carried by the piston.

6. A dispenser according to claim 5 wherein the cam surface is one of at least three cam surfaces carried by the cam ring and the cam follower is one of a plurality of cam followers, each of the cam followers comprising an arm projecting through one of the slots.

7. A dispenser according to claim 6 wherein each of the cam followers projects into a sloping slot or groove defined in the cam ring and each of the cam surfaces is provided by an edge of a corresponding one of the sloping slots or grooves.

8. A dispenser according to claim 7 wherein the body is formed to provide at least three slots, the piston comprises at least three arms, each of the at least three arms extending into one of the at least three slots, and the cam surfaces of the cam ring include plural cam surfaces disposed to longitudinally displace corresponding cam followers on corresponding ones of the at least three arms.

9. A dispenser according to claim 8 wherein the at least three slots are evenly spaced apart around a circumference of the body.

10. A dispenser according to claim 1 wherein the body is formed to provide a row of teeth spaced apart along the body and the ratchet comprises a ratchet tooth carried with the piston and biased into engagement with the teeth on the body.

11. A dispenser according to claim 10 wherein the teeth on the body comprise teeth formed along one edge of each of the at least three slots.

12. A dispenser according to claim 10 wherein the engagement feature of the locking member comprises a tooth arranged to mechanically engage the teeth on the body.

13. A dispenser according to claim 10 comprising a piston return track formed inside a bore of the body, the piston return track extending along the slot on a side of the slot opposed to the teeth from a first opening proximate a first end of the slot to a second opening proximate a second end of the slot wherein the ratchet comprises a return tongue coupled to the ratchet tooth and the ratchet tooth connected to the piston is held out of engagement with the teeth on the body when the return tongue is received within the piston return track.

14. A dispenser according to claim 10 wherein a travel distance of the piston when actuated by the piston driving part is equal to or a multiple of a distance that the teeth on the body are spaced apart from one another.

15. A dispenser according to claim 1 comprising one or more guide tracks extending longitudinally inside a bore of the body and one or more guide tongues projecting from the piston into the guide tracks, wherein engagement of the guide tongues in the guide tracks limits rotation of the piston in the body.

16. A dispenser according to claim 1 comprising a pouch contained within the body, the pouch containing a material to be dispensed.

17. A dispenser according to claim 1 wherein the piston-actuation mechanism is located longitudinally entirely between the ends of the body.

18. A dispenser according to claim 2 comprising a spring coupled between the grip ring and the cam ring such that rotation of the cam ring urges the grip ring to rotate until the engagement feature of the locking member mechanically engages the corresponding feature of the body and continued rotation of the cam ring is permitted by extension or compression of the spring.

19. A dispenser according to claim 1 comprising one or more bearings mounted on the piston-actuation mechanism, the bearings facilitating longitudinal motion of the piston-actuation mechanism relative to the body when the locking member is in the released position.

20. A dispenser comprising:

a tubular dispenser body having a first end and a second end;

a piston movably disposed within the dispenser body;

means for dispensing a flowable material from the second end of the dispenser body;

an anchor means movable along an outside of the dispenser body;

a piston-actuation mechanism comprising:

locking means for releasably holding the anchor means at a longitudinal position along the dispenser body; and piston-driving means for incrementally advancing the piston toward the second end of the dispenser body relative to the anchor means while the anchor means is held by the locking means; and a bias means for urging the anchor means toward the second end of the dispenser body relative to the piston.

21. A dispenser comprising a tubular dispenser body having a first end and a second end;

a piston movably disposed within the dispenser body;

means for dispensing a flowable material from the second end of the dispenser body;

an anchor means movable along an outside of the dispenser body;

a piston-actuation mechanism comprising:

locking means for releasably holding the anchor means at a longitudinal position along the dispenser body; and piston-driving means for incrementally advancing the piston toward the second end of the dispenser body relative to the anchor means while the anchor means is held by the locking means;

a bias means for urging the anchor means toward the second end of the dispenser body relative to the piston; and a rotatable grip, means for actuating the locking means when the rotatable grip is rotated relative to the dispenser body and means for actuating the piston-driving means in response to further rotation of the rotatable grip.

22. A method for dispensing a flowable material from a dispenser, the method comprising:

placing a pouch containing the flowable material inside a body of a dispenser;

incrementally advancing a piston in a forward direction to dispense corresponding portions of the flowable material by steps including:

engaging an anchor to the body such that the anchor resists longitudinal movement relative to the body;

applying a force between the anchor and the piston to advance the piston incrementally in the forward direction and to store energy in a deformable bias member;

releasing the anchor from the body to allow the anchor to move longitudinally relative to the body and applying stored energy from the deformable bias member to incrementally move the anchor along the body in the forward direction to a next location along the body; and, repeating the above steps to dispense another of the portions starting with the anchor in the next location along the body.

* * * * *